US010510294B2

(12) United States Patent
Yang et al.

(10) Patent No.: US 10,510,294 B2
(45) Date of Patent: Dec. 17, 2019

(54) PIXEL DRIVING CIRCUIT, METHOD FOR DRIVING THE SAME AND DISPLAY DEVICE

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN); Can Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/580,447

(22) PCT Filed: Jun. 28, 2017

(86) PCT No.: PCT/CN2017/090539

§ 371 (c)(1),
(2) Date: Dec. 7, 2017

(87) PCT Pub. No.: WO2018/076745

PCT Pub. Date: May 3, 2018

(65) Prior Publication Data

US 2019/0340979 A1 Nov. 7, 2019

(30) Foreign Application Priority Data

Oct. 28, 2016 (CN) ..... 2016 1 0975825

(51) Int. Cl.
*G09G 3/3233* (2016.01)
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2320/0626* (2013.01)

(58) Field of Classification Search
CPC ..... G09G 3/3258; G09G 3/3266; G09G 2320/0626
See application file for complete search history.

(56) References Cited

U.S. PATENT DOCUMENTS

2005/0104817 A1* 5/2005 Kwak ..... G09G 3/2022 345/76
2006/0145964 A1* 7/2006 Park ..... G09G 3/3233 345/76

(Continued)

FOREIGN PATENT DOCUMENTS

CN 1801298 A 7/2006
CN 104134426 A 11/2014

(Continued)

OTHER PUBLICATIONS

First Office Action for Chinese Application No. 201610975825.4, dated May 31, 2017, 5 Pages.

(Continued)

*Primary Examiner* — Benyam Ketema
(74) *Attorney, Agent, or Firm* — Brooks Kushman P.C.

(57) ABSTRACT

A pixel driving circuit, a driving method thereof and a display device are provided. The pixel driving circuit includes a driving control unit, a light-emission control signal generation unit and a pixel driving unit. The driving control unit is configured to generate a low resolution control signal or a high resolution control signal. The pixel driving unit includes N pixel driving sub-units. Each pixel driving sub-unit is configured to control M light-emitting elements connected to the pixel driving sub-unit to emit light simultaneously when the light-emission control signal generation unit has received the low resolution control signal, and control the M light-emitting elements to emit light in a time-division manner based on M data voltages applied to a data line in a time-division manner when the light-emission (Continued)

control signal generation unit has received the high resolution control signal, where N and M are both integers greater than 1.

20 Claims, 8 Drawing Sheets

(56) References Cited

U.S. PATENT DOCUMENTS

| | | | | |
|---|---|---|---|---|
| 2006/0186822 | A1* | 8/2006 | Park | G09G 3/3233 315/169.3 |
| 2010/0283776 | A1* | 11/2010 | Park | G09G 3/3233 345/211 |
| 2015/0022428 | A1* | 1/2015 | Liu | G09G 3/3225 345/76 |
| 2015/0294619 | A1* | 10/2015 | Lee | G09G 3/3266 345/77 |
| 2016/0012774 | A1* | 1/2016 | Ohara | G09G 3/2025 345/694 |
| 2016/0019836 | A1* | 1/2016 | Qing | G09G 3/3233 345/76 |
| 2016/0155385 | A1* | 6/2016 | Yang | G09G 3/3233 345/174 |
| 2017/0178582 | A1* | 6/2017 | Li | G09G 3/3607 |
| 2017/0200415 | A1* | 7/2017 | Noguchi | G09G 3/3258 |
| 2017/0263180 | A1 | 9/2017 | Zhu | |
| 2018/0182296 | A1* | 6/2018 | Wang | G09G 3/3258 |

FOREIGN PATENT DOCUMENTS

| | | | |
|---|---|---|---|
| CN | 105074808 | A | 11/2015 |
| CN | 105096838 | A | 11/2015 |
| CN | 105427807 | A | 3/2016 |
| CN | 106297672 | A | 1/2017 |
| EP | 1679687 | A2 | 7/2006 |
| EP | 1679687 | B1 | 6/2012 |
| EP | 3168832 | A1 | 5/2017 |
| KR | 1020060056786 | A | 5/2006 |
| WO | 2016009909 | A1 | 1/2016 |

OTHER PUBLICATIONS

International Search Report and Written Opinion for Application No. PCT/CN2017/090539, dated Sep. 27, 2017, 12 Pages.

Notification to Grant Patent Right for Invention for Chinese Application No. 201610975825.4, dated Aug. 1, 2017, 3 Pages.

Chinese Search Report for Chinese Application No. 201610975825.4 dated Feb. 28, 2017, 5 Pages.

* cited by examiner

PIXEL DRIVING CIRCUIT, METHOD FOR DRIVING THE SAME AND DISPLAY DEVICE

CROSS-REFERENCE TO RELATED APPLICATION APPLICATIONS

This application is the U.S. national phase of PCT Application No. PCT/CN2017/090539 filed on Jun. 28, 2017, which claims priority to Chinese Patent Application No. 201610975825.4 filed on Oct. 28, 2016, which are incorporated herein by reference in their entireties.

TECHNICAL FIELD

The present disclosure relates to the field of display driving technology, in particular to a pixel driving circuit, a method for driving the pixel driving circuit and a display device.

BACKGROUND

In the related art, it is merely able for a pixel driving circuit to set a display resolution of a display panel, rather than to adjust the resolution or provide a low power mode. In addition, a large number of data lines and transistors are adopted by a conventional single-pixel compensation driving circuit, so it is unable to reduce a pixel pitch, and thereby it is unable to acquire higher image quality and higher Pixels Per Inch (PPI).

SUMMARY

A main object of the present disclosure is to provide a pixel driving circuit, a method for driving the pixel driving circuit and a display device, so as to solve the above-mentioned problems.

In one aspect, the present disclosure provides in some embodiments a pixel driving circuit, including a driving control unit, a light-emission control signal generation unit and a pixel driving unit. The pixel driving unit includes N pixel driving sub-units connected to a same data line. The driving control unit is configured to generate a low resolution control signal or a high resolution control signal. The light-emission control signal generation unit is connected to the driving control unit and M*N light-emission control lines and configured to generate a corresponding light-emission control signal for each of the M*N light-emission control lines in accordance with the low resolution control signal or the high resolution control signal. Each of the pixel driving sub-units is connected to M light-emitting elements, a scanning line and M light-emission control lines and configured to, under the control of a data write-in control signal from the scanning line and the light-emission control signal from each of the M light-emission control lines, control the M light-emitting elements connected to the pixel driving sub-unit to emit light simultaneously in accordance with a same data voltage applied to the data line when the light-emission control signal generation unit has received the low resolution control signal, and control the M light-emitting elements to emit light in a time-division manner in accordance with the M data voltages applied to the data line in a time-division manner when the light-emission control signal generation unit has received the high resolution control signal. N and M are both integers greater than 1.

In a possible embodiment of the present disclosure, each pixel driving sub-unit includes a driving transistor and a pixel driving control module connected to each other. The driving transistor is connected to the M light-emitting elements through the pixel driving control module. The pixel driving control module is further connected to the scanning line and the M light-emission control lines and configured to, under the control of the data write-in control signal from the scanning line and the light-emission control signal from each of the M light-emission control lines, enable the driving transistor to drive the M light-emitting elements connected to the pixel driving sub-unit to emit light simultaneously in accordance with a same data voltage applied to the data line when the light-emission control signal generation unit has received the low resolution control signal, and enable, in a time-division manner, the driving transistor to drive the M light-emitting elements to emit light in a time-division manner in accordance with M data voltages applied to the data line in a time-division manner when the light-emission control signal generation unit has received the high resolution control signal.

In a possible embodiment of the present disclosure, an $n^{th}$ pixel driving control module includes: an $n^{th}$ resetting sub-module connected to a resetting end, an $n^{th}$ start signal output end and a gate electrode of an $n^{th}$ driving transistor and configured to enable the $n^{th}$ start signal output end to be electrically connected to the gate electrode of the $n^{th}$ driving transistor under the control of a resetting control signal from the resetting end; an $n^{th}$ charging/discharging sub-module, a first end of which is connected to a voltage output end, and a second end of which is connected to the gate electrode of the $n^{th}$ driving transistor; an $n^{th}$ compensation sub-module connected to an $n^{th}$ scanning line, the data line, the gate electrode of the $n^{th}$ driving transistor, and a first electrode and a second electrode of the $n^{th}$ driving transistor, and configured to, under the control of an $n^{th}$ data write-in control signal from the $n^{th}$ scanning line, apply the data voltage from the data line to the second electrode of the $n^{th}$ driving transistor and enable the gate electrode of the $n^{th}$ driving transistor to be electrically connected to the first electrode of the $n^{th}$ driving transistor, so as to charge or discharge the $n^{th}$ charging/discharging sub-module; an $n^{th}$ driving control sub-module connected to a driving control line, a high level output end and the first electrode of the $n^{th}$ driving transistor, and configured to, under the control of a driving control signal from the driving control line, enable the first electrode of the $n^{th}$ driving transistor to be electrically connected to the high level output end; and an $n^{th}$ light-emission control sub-module connected to the M light-emitting elements and M light-emission control lines, and configured to, under the control of the light-emission control signal from each of the M light-emission control lines, enable the $n^{th}$ driving transistor to drive the M light-emitting elements connected to the pixel driving sub-unit to emit light simultaneously in accordance with a same data voltage applied to the data line when the light-emission control signal generation unit has received the low resolution control signal, and enable, in a time-division manner, the $n^{th}$ driving transistor to drive the M light-emitting elements to emit light in a time-division manner in accordance with M data voltages applied to the data line in a time-division manner when the light-emission control signal generation unit has received the high resolution control signal, where n is a positive integer greater than or equal to 1 and smaller than or equal to N.

In a possible embodiment of the present disclosure, the $n^{th}$ compensation sub-module includes: a first compensation transistor, a gate electrode of which is connected to the $n^{th}$ scanning line, a first electrode of which is connected to the data line, and a second electrode of which is connected to the second electrode of the $n^{th}$ driving transistor; and a second compensation transistor, a gate electrode of which is connected to the $n^{th}$ scanning line, a first electrode of which is connected to the gate electrode of the $n^{th}$ driving transistor, and a second electrode of which is connected to the first electrode of the $n^{th}$ driving transistor.

In a possible embodiment of the present disclosure, the nth driving control sub-module includes an $n^{th}$ driving control transistor, a gate electrode of which is connected to the driving control line, a first electrode of which is connected to the high level output end, and a second electrode of which is connected to the first electrode of the $n^{th}$ driving transistor. The $n^{th}$ light-emission control sub-module includes M light-emission control transistors. A gate electrode of each light-emission control transistor is connected to one of the light-emission control lines, a first electrode thereof is connected to the second electrode of the $n^{th}$ driving transistor, and a second electrode thereof is connected to one of the light-emitting elements.

In a possible embodiment of the present disclosure, the resetting sub-module includes a resetting transistor, a gate electrode of which is connected to the resetting end, a first electrode of which is connected to the $n^{th}$ start signal output end, and a second electrode of which is connected to the gate electrode of the $n^{th}$ driving transistor. The $n^{th}$ charging/discharging sub-module includes an $n^{th}$ storage capacitor, a first end of which is connected to a voltage output end, and a second end of which is connected to the gate electrode of the $n^{th}$ driving transistor.

In a possible embodiment of the present disclosure, when the $n^{th}$ driving transistor is a p-type transistor, a difference between an $n^{th}$ start signal from the $n^{th}$ start signal output end and a data voltage outputted by the data line under the control of the $n^{th}$ data write-in control signal from the $n^{th}$ scanning line is smaller than a threshold voltage of the $n^{th}$ driving transistor.

In a possible embodiment of the present disclosure, when the nth driving transistor is an n-type transistor, a difference between an $n^{th}$ start signal from the $n^{th}$ start signal output end and a data voltage outputted by the data line under the control of the $n^{th}$ data write-in control signal from the $n^{th}$ scanning line is greater than or equal to a threshold voltage of the $n^{th}$ driving transistor.

In a possible embodiment of the present disclosure, when the $n^{th}$ charging/discharging sub-module stops to be charged or discharged, a potential at the gate electrode of the $n^{th}$ driving transistor is equal to a sum of the data voltage and the threshold voltage of the $n^{th}$ driving transistor.

In a possible embodiment of the present disclosure, the pixel driving control module is further configured to, when the driving transistor drives the M light-emitting elements connected to the pixel driving sub-unit to emit light simultaneously or in a time-division manner, compensate for the threshold voltage of the driving transistor.

In a possible embodiment of the present disclosure, the pixel driving control module is further configured to compensate for the threshold voltage of the driving transistor with a gate-to-source voltage of the driving transistor.

In a possible embodiment of the present disclosure, the light-emitting element is an organic light-emitting diode (OLED), an anode of which is connected to the pixel driving sub-unit, and a cathode of which is grounded.

In a possible embodiment of the present disclosure, the driving control unit is configured to generate the low resolution control signal or the high resolution control signal in accordance with an external distance, and the external distance is a distance between a human eye and a display panel.

In another aspect, the present disclosure provides in some embodiments a method for driving the above-mentioned pixel driving circuit, including: a display control signal generation step of generating, by the driving control unit, a low resolution control signal or a high resolution control signal, and transmitting the low resolution control signal or the high resolution control signal to the light-emission control signal generation unit; a light-emission control signal generation step of generating, by the light-emission control signal generation unit, a corresponding light-emission control signal for each of M*N light-emission control lines in accordance with the low resolution control signal or the high resolution control signal; and a display driving step of, under the control of a data write-in control signal from a scanning line and the light-emission control signal from each of the M light-emission control lines, enabling, by each of the pixel driving sub-units, the M light-emitting elements connected to the pixel driving sub-unit to emit light simultaneously in accordance with a same data voltage applied to the data line when the light-emission control signal generation unit has received the low resolution control signal, or enabling, by each of the pixel driving sub-units, the M light-emitting elements to emit light in a time-division manner in accordance with M data voltages applied to the data line in a time-division manner when the light-emission control signal generation unit has received the high resolution control signal, where N and M are both integers greater than 1.

In a possible embodiment of the present disclosure, each pixel driving sub-unit includes a driving transistor and a pixel driving control module connected to each other and the driving transistor is connected to the M light-emitting elements through the pixel driving control module, the display driving step includes: when the light-emission control signal generation unit has received the low resolution control signal, under the control of the data write-in control signal from the scanning line and the light-emission control signal from each of the M light-emission control lines, enabling, by the pixel driving control module, the driving transistor to drive the M light-emitting elements connected to the pixel driving sub-unit to emit light simultaneously in accordance with a same data voltage applied to the data line; or when the light-emission control signal generation unit has received the high resolution control signal, under the control of the data write-in control signal from the scanning line and the light-emission control signal from each of the M light-emission control lines, enabling, by the pixel driving control module, the driving transistor to drive the M light-emitting elements to emit light in a time-division manner in accordance with M data voltages applied to the data line in a time-division manner.

In a possible embodiment of the present disclosure, the display driving step further includes, when the driving transistor drives the M light-emitting elements connected to the pixel driving sub-unit to emit light simultaneously or in a time-division manner, compensating for a threshold voltage of the driving transistor with a gate-to-source voltage of the driving transistor.

In a possible embodiment of the present disclosure, the display driving step further includes: enabling, by an $n^{th}$ resetting sub-module, an $n^{th}$ start signal output end to be electrically connected to a gate electrode of an $n^{th}$ driving transistor under the control of a resetting control signal from a resetting end; under the control of an $n^{th}$ data write-in control signal from an $n^{th}$ scanning line, applying, by an $n^{th}$ compensation sub-module, a data voltage from the data line to a second electrode of the $n^{th}$ driving transistor and enabling the gate electrode of the $n^{th}$ driving transistor to be electrically connected to a first electrode of the $n^{th}$ driving transistor, so as to charge or discharge an $n^{th}$ charging/discharging sub-module; enabling, by an $n^{th}$ driving control sub-module, the first electrode of the $n^{th}$ driving transistor to be electrically connected to a high level output end under the control of a driving control signal from a driving control line; and under the control of the light-emission control signal from each of the M light-emission control lines, enabling, by an $n^{th}$ light-emission control sub-module, the $n^{th}$ driving transistor to drive the M light-emitting elements connected to the pixel driving sub-unit to emit light simultaneously in accordance with a same data voltage applied to the data line when the light-emission control signal generation unit has received the low resolution control signal, or enabling, by the $n^{th}$ light-emission control sub-module, the $n^{th}$ driving transistor to drive the M light-emitting elements to emit light in a time-division manner in accordance with M data voltages applied to the data line in a time-division manner when the light-emission control signal generation unit has received the high resolution control signal.

In a possible embodiment of the present disclosure, each display period includes M display sub-periods. Each display sub-period includes a resetting stage, a compensation stage and a light-emission stage. The compensation stage includes N compensation time periods, and the light-emission stage includes N light-emission time periods. The display driving step further includes, when the light-emission control signal generation unit has received the high resolution control signal, within an $m^{th}$ display sub-period: at the resetting stage, enabling, by the resetting sub-module, a gate electrode of a corresponding driving transistor to receive a corresponding start signal under the control of the resetting control signal from the resetting end; within an $n^{th}$ compensation time period of the compensation stage, under the control of an $n^{th}$ data write-in control signal from the $n^{th}$ scanning line, applying, by the $n^{th}$ compensation sub-module, the data voltage from the data line to the second electrode of the $n^{th}$ driving transistor, and enabling the gate electrode of the $n^{th}$ driving transistor to be electrically connected to the first electrode of the $n^{th}$ driving transistor, so as to charge or discharge the $n^{th}$ charging/discharging sub-module until a potential at the gate electrode of the $n^{th}$ driving transistor is equal to a sum of the data voltage and the threshold voltage of the $n^{th}$ driving transistor; and within an $n^{th}$ light-emission time period of the light-emission stage, enabling, by the $n^{th}$ driving control sub-module, the first electrode of the $n^{th}$ driving transistor to be electrically connected to the high level output end under the control of the driving control signal from the driving control line, and under the control of an $m^{th}$ light-emission control signal from an $m^{th}$ light-emission control line, enabling, by the $n^{th}$ light-emission control sub-module, the $n^{th}$ driving transistor to drive an $m^{th}$ light-emitting element connected to the $n^{th}$ pixel driving control module to emit light in accordance with the data voltage, and compensating for the threshold voltage of the $n^{th}$ driving transistor with the gate-to-source voltage of the $n^{th}$ driving transistor, where m is an integer greater than or equal to 1 and smaller than or equal to M.

In a possible embodiment of the present disclosure, each display period includes M display sub-periods. Each display sub-period includes a resetting stage, a compensation stage and a light-emission stage. The compensation stage includes N compensation time periods, and the light-emission stage includes N light-emission time periods. The display driving step further includes, when the light-emission control signal generation unit has received the low resolution control signal, within an $m^{th}$ display sub-period: at the resetting stage, enabling, by the resetting sub-module, a gate electrode of a corresponding driving transistor to receive a corresponding start signal under the control of the resetting control signal from the resetting end; within an $n^{th}$ compensation time period of the compensation stage, under the control of an $n^{th}$ data write-in control signal from the $n^{th}$ scanning line, applying, by the $n^{th}$ compensation sub-module, the data voltage from the data line to the second electrode of the $n^{th}$ driving transistor, and enabling the gate electrode of the $n^{th}$ driving transistor to be electrically connected to the first electrode of the $n^{th}$ driving transistor, so as to charge or discharge the $n^{th}$ charging/discharging sub-module until a potential at the gate electrode of the $n^{th}$ driving transistor is equal to a sum of the data voltage and the threshold voltage of the $n^{th}$ driving transistor; and within an $n^{th}$ light-emission time period of the light-emission stage, enabling, by the $n^{th}$ driving control sub-module, the first electrode of the $n^{th}$ driving transistor to be electrically connected to the high level output end under the control of the driving control signal from the driving control line, and under the control of the M light-emission control signals from the M light-emission control lines, enabling, by the $n^{th}$ light-emission control sub-module, the M light-emitting elements connected to the $n^{th}$ pixel driving control module to emit light simultaneously in accordance with the data voltage, and compensating for the threshold voltage of the $n^{th}$ driving transistor with the gate-to-source voltage of the $n^{th}$ driving transistor, where m is an integer greater than or equal to 1 and smaller than or equal to M.

In a possible embodiment of the present disclosure, the display control signal generation step further includes generating, by the driving control unit, the low resolution control signal or the high resolution control signal in accordance with an external distance. The external distance is a distance between a human eye and a display panel.

In yet another aspect, the present disclosure provides in some embodiments a display device including a display panel and the above-mentioned pixel driving circuit.

In a possible embodiment of the present disclosure, the display device further includes a human eye detection unit connected to a driving control unit of the pixel driving circuit and configured to detect a distance between a human eye and the display panel and transmit the distance to the driving control unit. The driving control unit is configured to, when the distance is greater than or equal to a predetermined distance, transmit a low resolution control signal to the pixel driving unit, and when the distance is smaller than the predetermined distance, transmit a high resolution control signal to the pixel driving unit.

DETAILED DESCRIPTION

Figure 1:
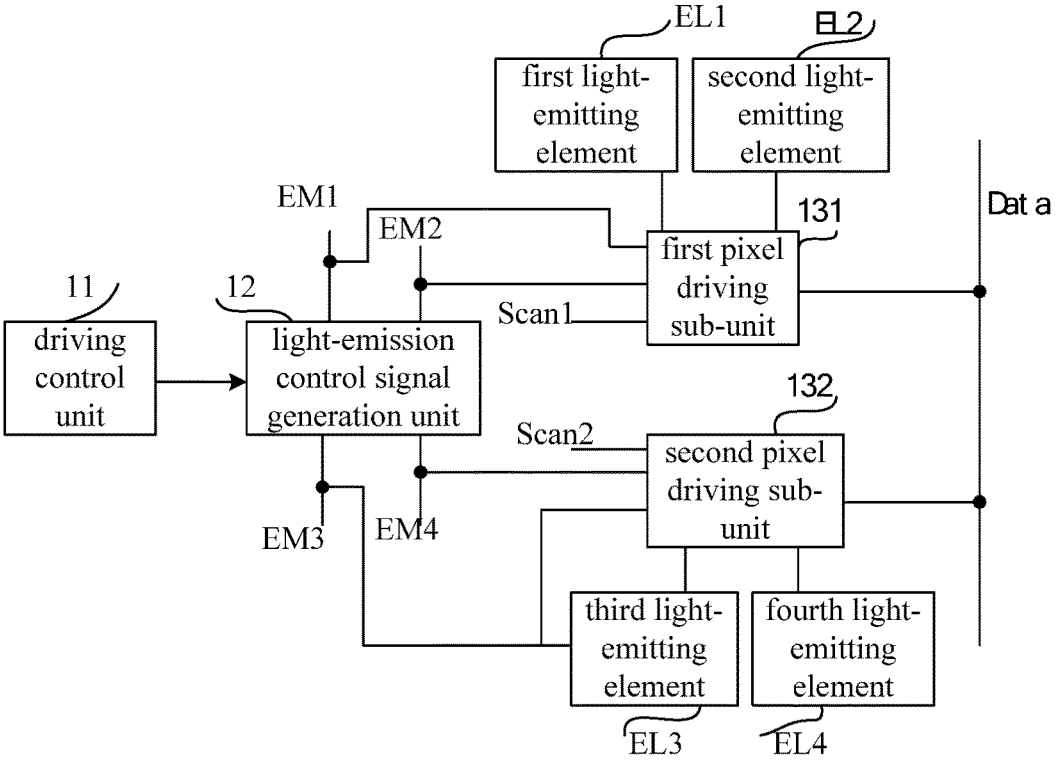
FIG. 1 is a schematic view showing a pixel driving circuit according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

The present disclosure provides in some embodiments a pixel driving circuit, which includes a driving control unit, a light-emission control signal generation unit and a pixel driving unit. The driving control unit is configured to generate a low resolution control signal or a high resolution control signal. In a possible embodiment of the present disclosure, the driving control unit may generate the low resolution control signal or the high resolution control signal in accordance with an external distance, and the external distance is a distance between a human eye and a display panel. The light-emission control signal generation unit is connected to the driving control unit and M*N light-emission control lines and configured to generate a corresponding light-emission control signal for each of the M*N light-emission control lines in accordance with the low resolution control signal or the high resolution control signal. The pixel driving unit includes N pixel driving sub-units connected to a same data line. Each of the pixel driving sub-units is connected to M light-emitting elements, a corresponding scanning line and corresponding M light-emission control lines and configured to, under the control of a data write-in control signal from the scanning line and the light-emission control signals from the M light-emission control lines, control the M light-emitting elements connected to the pixel driving sub-unit to emit light simultaneously in accordance with a same data voltage applied to the data line when the light-emission control signal generation unit has received the low resolution control signal, and control the M light-emitting elements to emit light in a time-division manner in accordance with the M data voltages applied to the data line in a time-division manner when the light-emission control signal generation unit has received the high resolution control signal. N and M are both integers greater than 1.

Under the control of the low resolution control signal, the pixel driving circuit is in a low resolution display mode, and at this time, the resolution is smaller than or equal to a resolution threshold. Under the control of the high resolution control signal, the pixel driving circuit is in a high resolution display mode, and at this time, the resolution is greater than the resolution threshold.

According to the pixel driving circuit in the embodiments of the present disclosure, it is able to intelligently adjust the resolution, thereby to dynamically and intelligently adjust a resolution of the display panel, and provide a low power mode. In addition, pixels in a plurality of columns are controlled by a same data line, and one pixel driving circuit is used to drive a plurality of pixels, so as to reduce the number of compensation thin film transistors (TFTs), remarkably reduce the pixel pitch and acquire higher image quality and higher PPI.

In actual use, the driving control unit of the pixel driving circuit may generate the low resolution control signal or the high resolution control signal in accordance with the distance between the human eye and the display panel, or in accordance with any other situations where the resolution needs to be adjusted. Then, the light-emission control signal generation unit may generate the corresponding light-emission control signal in accordance with the corresponding resolution control signal. When it is necessary to display an image at a high resolution, the pixel driving sub-unit may control, in a time-division manner, the M light-emitting elements (which are adjacently arranged in a same column) to emit light in a time-division manner in accordance with the M data voltages applied to the data line in a time-division manner. When it is merely necessary to display the image at a low resolution, the pixel driving sub-unit may control the M light-emitting elements connected to the pixel driving sub-unit to emit light simultaneously in accordance with the same data voltage applied to the data line, so as to effectively reduce the power consumption of the display panel while ensuring a display effect, thereby to selectively switch the resolution for the display panel and enable the resolution to be adjustable.

In actual use, the light-emitting element may be an Organic Light-Emitting Diode (OLED), or any other light-emitting member.

The pixel driving circuit in the embodiments of the present disclosure will be described hereinafter in conjunction with the drawings when N and M are each 2.

As shown in FIG. 1, the pixel driving circuit includes a driving control unit 11, a light-emission control signal generation unit 12 and a pixel driving unit. The driving control unit 11 is configured to generate a low resolution control signal or a high resolution control signal in accordance with an external distance, and the external distance is a distance between a human eye and a display panel. The light-emission control signal generation unit 12 is connected to the driving control unit 11, a first light-emission control line EM1, a second light-emission control line EM2, a third light-emission control line EM3 and a fourth light-emission control line EM4, and configured to generate a corresponding light-emission control signal for each of the first light-emission control line EM1, the second light-emission control line EM2, the third light-emission control line EM3 and the fourth light-emission control line EM4 in accordance with the low resolution control signal or the high resolution control signal. The pixel driving unit includes a first pixel driving sub-unit 131 and a second pixel driving sub-unit 132 connected to a same data line Data. The first pixel driving sub-unit 131 is connected to a first light-emitting element EL1, a second light-emitting element EL2, a first scanning line Scan1, the first light-emission control line EM1 and the second light-emission control line EM2, and configured to, under the control of a first data write-in control signal from the first scanning line Scan1, a first light-emission control signal from the first light-emission control line EM1 and a second light-emission control signal from the second light-emission control line EM2, control the first light-emitting element EL1 and the second light-emitting element EL2 to emit light simultaneously in accordance with a same data voltage applied to the data line Data when the light-emission control signal generation unit 12 has received the low resolution control signal, and control the first light-emitting element EL1 and the second light-emitting element EL2 to emit light in a time-division manner in accordance with two data voltages applied to the data line Data in a time-division manner when the light-emission control signal generation unit 12 has received the high resolution control signal. The second pixel driving sub-unit 132 is connected to a third light-emitting element EL3, a fourth light-emitting element EL4, a second scanning line Scan2, the third light-emission control line EM3 and the fourth light-emission control line EM4, and configured to, under the control of a second data write-in control signal from the second scanning line Scan2, a third light-emission control signal from the third light-emission control line EM3 and a fourth light-emission control signal from the fourth light-emission control line EM4, control the third light-emitting element EL3 and the fourth light-emitting element EL4 to emit light simultaneously in accordance with a same data voltage applied to the data line Data when the light-emission control signal generation unit 12 has received the low resolution control signal, and control the third light-emitting element EL3 and the fourth light-emitting element EL4 to emit light in a time-division manner in accordance with two data voltages applied to the data line Data in a time-division manner when the light-emission control signal generation unit 12 has received the high resolution control signal. In actual use, EL1 and EL2 may be arranged in a same column and in two adjacent rows, and EL3 and EL4 may be arranged in a same column and in two adjacent rows.

In a possible embodiment of the present disclosure, the driving control unit may generate the low resolution control signal or the high resolution control signal in accordance with the distance between the human eye and the display panel. To be specific, the driving control unit may be configured to transmit the low resolution control signal to the pixel driving unit when the external distance is greater than or equal to a predetermined distance, and transmit the high resolution control signal to the pixel driving unit when the external distance is smaller than the predetermined distance.

In actual use, the predetermined distance may be set according to the practical need, e.g., in accordance with a requirement on the resolution of the display panel and a size of the display panel. For example, when the display panel is of a small size, the predetermined distance may have a relatively small value, and when the display panel is of a large size, the predetermined distance may have a relatively large value. In addition, when a display effect (e.g., the resolution) of the display panel is highly demanded, the predetermined distance may have a relatively large value, and when the display effect of the display panel is not so highly demanded, the predetermined distance may have a relatively small value.

In a possible embodiment of the present disclosure, each pixel driving sub-unit includes a driving transistor and a pixel driving control module connected to each other. The driving transistor is connected to the M light-emitting elements through the pixel driving control module. The pixel driving control module is further connected to the corresponding scanning line and the M light-emission control lines and configured to, under the control of the data write-in control signal from the scanning line and the light-emission control signals from the M light-emission control lines, when the light-emission control signal generation unit has received the low resolution control signal, enable the driving transistor to drive the M light-emitting elements connected to the pixel driving sub-unit to emit light simultaneously in accordance with a same data voltage applied to the data line and compensate for a threshold voltage of the driving transistor with a gate-to-source voltage of the driving transistor, and when the light-emission control signal generation unit has received the high resolution control signal, enable, in a time-division manner, the driving transistor to drive the M light-emitting elements to emit light in a time-division manner in accordance with M data voltages applied to the data line in a time-division manner and compensate for a threshold voltage of the driving transistor with a gate-to-source voltage of the driving transistor.

When the light-emission control signal generation unit has received the high resolution control signal or the low resolution control signal, the pixel driving control module is further configured to compensate for the threshold voltage while driving the light-emitting elements to emit light. As a result, it is able to prevent the occurrence of display non-uniformity due to the drift of the threshold voltage of the driving TFT caused by a manufacture process or long-term operation, and prevent the current flowing through each pixel point OLED from being adversely affected by the threshold voltage of the driving transistor, thereby to ensure the display uniformity of the image.

In a possible embodiment of the present disclosure, an $n^{th}$ pixel driving control module may include: an $n^{th}$ resetting sub-module connected to a resetting end, an $n^{th}$ start signal output end and a gate electrode of an $n^{th}$ driving transistor connected to the $n^{th}$ pixel driving control module, and configured to enable the $n^{th}$ start signal output end to be electrically connected to the gate electrode of the $n^{th}$ driving transistor under the control of a resetting control signal from the resetting end; an $n^{th}$ charging/discharging sub-module, a first end of which is connected to a voltage output end, and a second end of which is connected to the gate electrode of the $n^{th}$ driving transistor; an $n^{th}$ compensation sub-module connected to an $n^{th}$ scanning line, the data line, the gate electrode of the $n^{th}$ driving transistor, and a first electrode and a second electrode of the $n^{th}$ driving transistor, and configured to, under the control of an $n^{th}$ data write-in control signal from the $n^{th}$ scanning line, apply the data voltage from the data line to the second electrode of the $n^{th}$ driving transistor and enable the gate electrode of the $n^{th}$ driving transistor to be electrically connected to the first electrode of the $n^{th}$ driving transistor, so as to charge or discharge the $n^{th}$ charging/discharging sub-module until a potential at the gate electrode of the $n^{th}$ driving transistor is equal to a sum of the data voltage and a threshold voltage of the $n^{th}$ driving transistor; an $n^{th}$ driving control sub-module connected to a driving control line, a high level output end and the first electrode of the $n^{th}$ driving transistor, and configured to, under the control of a driving control signal from the driving control line, enable the first electrode of the $n^{th}$ driving transistor to be electrically connected to the high level output end; and an $n^{th}$ light-emission control sub-module connected to the M light-emitting elements and M light-emission control lines, and configured to, under the control of the light-emission control signals from the M light-emission control lines, when the light-emission control signal generation unit has received the low resolution control signal, enable the $n^{th}$ driving transistor to drive the M light-emitting elements connected to the pixel driving sub-unit to emit light simultaneously in accordance with a same data voltage applied to the data line and compensate for the threshold voltage of the $n^{th}$ driving transistor with a gate-to-source voltage of the $n^{th}$ driving transistor, and when the light-emission control signal generation unit has received the high resolution control signal, enable, in a time-division manner, the $n^{th}$ driving transistor to drive the M light-emitting elements to emit light in a time-division manner in accordance with M data voltages applied to the data line in a time-division manner and compensate for the threshold voltage of the $n^{th}$ driving transistor with a gate-to-source voltage of the $n^{th}$ driving transistor, where n is a positive integer smaller than or equal to N.

Figure 2:
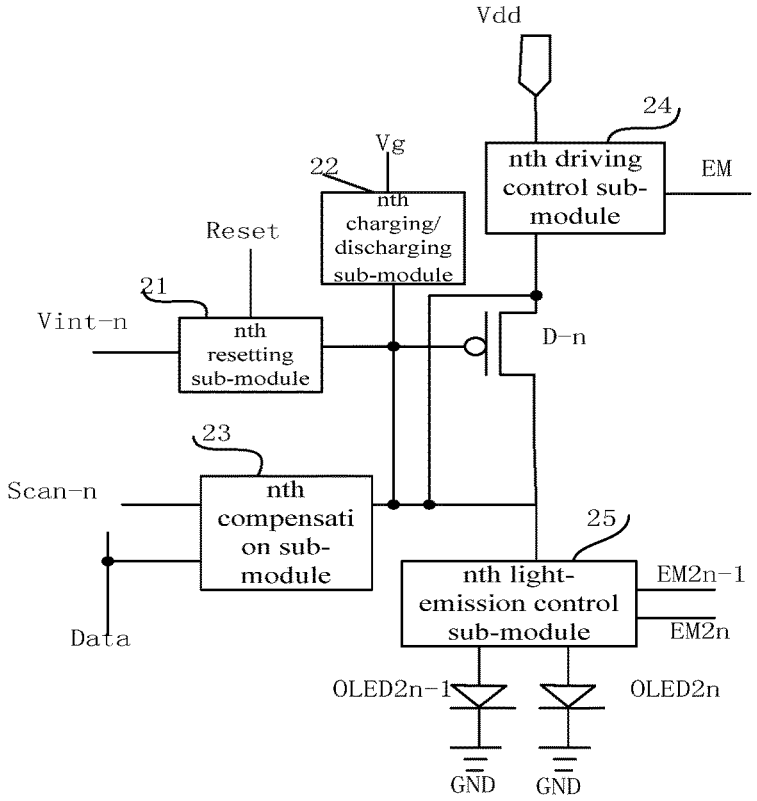
FIG. 2 is a schematic view showing an nth pixel driving control module of the pixel driving circuit according to one embodiment of the present disclosure.

To be specific, as shown in FIG. 2, when M is 2, the $n^{th}$ pixel driving control module includes: an $n^{th}$ resetting sub-module 21 connected to a resetting end Reset, an $n^{th}$ start signal output end for outputting an $n^{th}$ start signal Vint-n and a gate electrode of an $n^{th}$ driving transistor D-n connected to the $n^{th}$ pixel driving control module, and configured to enable the $n^{th}$ start signal output end to be electrically connected to the gate electrode of the $n^{th}$ driving transistor D-n under the control of a resetting control signal from the resetting end Reset; an $n^{th}$ charging/discharging sub-module 22, a first end of which is connected to a voltage output end for outputting a voltage Vg, and a second end of which is connected to the gate electrode of the $n^{th}$ driving transistor D-n; an $n^{th}$ compensation sub-module 23 connected to an $n^{th}$ scanning line Scan-n, the data line Data, and the gate electrode, a source electrode and a drain electrode of the $n^{th}$ driving transistor D-n, and configured to, under the control of an $n^{th}$ data write-in control signal from the $n^{th}$ scanning line Scan-n, apply the data voltage from the data line Data to the drain electrode of the $n^{th}$ driving transistor D-n and enable the gate electrode of the $n^{th}$ driving transistor D-n to be electrically connected to the source electrode of the $n^{th}$ driving transistor D-n, so as to charge the $n^{th}$ charging/discharging sub-module 22 until a potential at the gate electrode of the $n^{th}$ driving transistor D-n is equal to a sum of the data voltage and a threshold voltage of the $n^{th}$ driving transistor D-n; an $n^{th}$ driving control sub-module 24 connected to a driving control line EM, a high level output end for outputting a high level Vdd and the source electrode of the $n^{th}$ driving transistor D-n, and configured to, under the control of a driving control signal from the driving control line EM, enable the source electrode of the $n^{th}$ driving transistor D-n to be electrically connected to the high level output end for outputting the high level Vdd; and an $n^{th}$ light-emission control sub-module 25 connected to an anode of a $(2n-1)^{th}$ OLED OLED2*n*−1, an anode of a $(2n)^{th}$ OLED OLED2*n*, a $(2n-1)^{th}$ light-emission control line EM2*n*−1 and a $(2n)^{th}$ light-emission control line EM2*n*, and configured to, under the control of a $(2n-1)^{th}$ light-emission control signal from EM2*n*-1 and a $(2n)^{th}$ light-emission control signal from EM2*n*, when the light-emission control signal generation unit (not shown) has received the low resolution control signal, enable the $n^{th}$ driving transistor D-n to drive OLED2*n*−1 and OLED2*n* to emit light simultaneously in accordance with a same data voltage applied to the data line Data and compensate for the threshold voltage of the $n^{th}$ driving transistor D-n with a gate-to-source voltage of the $n^{th}$ driving transistor D-n, and when the light-emission control signal generation unit has received the high resolution control signal, enable, in a time-division manner, the $n^{th}$ driving transistor D-n to drive OLED2*n*-1 and OLED2*n* to emit light in a time-division manner in accordance with M data voltages applied to the data line Data in a time-division manner and compensate for the threshold voltage of the $n^{th}$ driving transistor D-n with a gate-to-source voltage of the $n^{th}$ driving transistor, where n is a positive integer smaller than or equal to N, and N is a positive integer greater than 1.

In FIG. 2, a cathode of OLED2*n*−1 and a cathode of OLED2*n* are both connected to a grounding end GND.

In FIG. 2, D-n is a p-type transistor. However, in actual use, D-n may also be an n-type transistor, i.e., a type of the driving transistor will not be particularly defined herein.

To be specific, when the $n^{th}$ driving transistor is a p-type transistor, a difference between the $n^{th}$ start signal Vini-n from the $n^{th}$ start signal output end and a data voltage outputted by the data line under the control of the $n^{th}$ data write-in control signal from the $n^{th}$ scanning line Scan-n is smaller than the threshold voltage of the $n^{th}$ driving transistor. In this way, D-n may be turned on at the beginning of a compensation stage, and after the $n^{th}$ charging/discharging sub-module 22 is charged until the potential at the gate electrode of the $n^{th}$ driving transistor D-n is equal to a sum of the data voltage and the threshold voltage of the $n^{th}$ driving transistor D-n, D-n may be turned off and a charging operation may be ceased.

When the $n^{th}$ driving transistor is an n-type transistor, a difference between the $n^{th}$ start signal Vini-n from the $n^{th}$ start signal output end and a data voltage outputted by the data line under the control of the $n^{th}$ data write-in control signal from the $n^{th}$ scanning line Scan-n is greater than or equal to the threshold voltage of the $n^{th}$ driving transistor D-n. In this way, D-n may be turned on at the beginning of the compensation stage, and after the $n^{th}$ charging/discharging sub-module 22 is discharged until the potential at the gate electrode of the $n^{th}$ driving transistor D-n is equal to a sum of the data voltage and the threshold voltage of the $n^{th}$ driving transistor D-n, D-n may be turned off and a discharging operation may be ceased.

In actual use, Vg may have a value sufficient to enable, at the compensation stage, the potential at the gate electrode of the $n^{th}$ driving transistor to be equal to a sum of the data voltage and the threshold voltage of the $n^{th}$ driving transistor through the charging or discharging operation of the $n^{th}$ charging/discharging sub-module.

To be specific, the $n^{th}$ compensation sub-module may include: a first compensation transistor, a gate electrode of which is connected to the $n^{th}$ scanning line, a first electrode of which is connected to the data line, and a second electrode of which is connected to the second electrode of the $n^{th}$ driving transistor; and a second compensation transistor, a gate electrode of which is connected to the $n^{th}$ scanning line, a first electrode of which is connected to the gate electrode of the $n^{th}$ driving transistor, and a second electrode of which is connected to the first electrode of the $n^{th}$ driving transistor.

To be specific, the $n^{th}$ driving control sub-module may include an $n^{th}$ driving control transistor, a gate electrode of which is connected to the driving control line, a first electrode of which is connected to the high level output end, and a second electrode of which is connected to the first electrode of the $n^{th}$ driving transistor. The $n^{th}$ light-emission control sub-module includes M light-emission control transistors. A gate electrode of each light-emission control transistor is connected to one of the light-emission control lines, a first electrode thereof is connected to the second electrode of the $n^{th}$ driving transistor, and a second electrode thereof is connected to one of the light-emitting elements.

To be specific, the resetting sub-module may include a resetting transistor, a gate electrode of which is connected to the resetting end, a first electrode of which is connected to the $n^{th}$ start signal output end, and a second electrode of which is connected to the gate electrode of the $n^{th}$ driving transistor. The $n^{th}$ charging/discharging sub-module may include an $n^{th}$ storage capacitor, a first end of which is connected to a voltage output end, and a second end of which is connected to the gate electrode of the $n^{th}$ driving transistor.

The pixel driving circuit will be described hereinafter in more details.

Figure 3A:
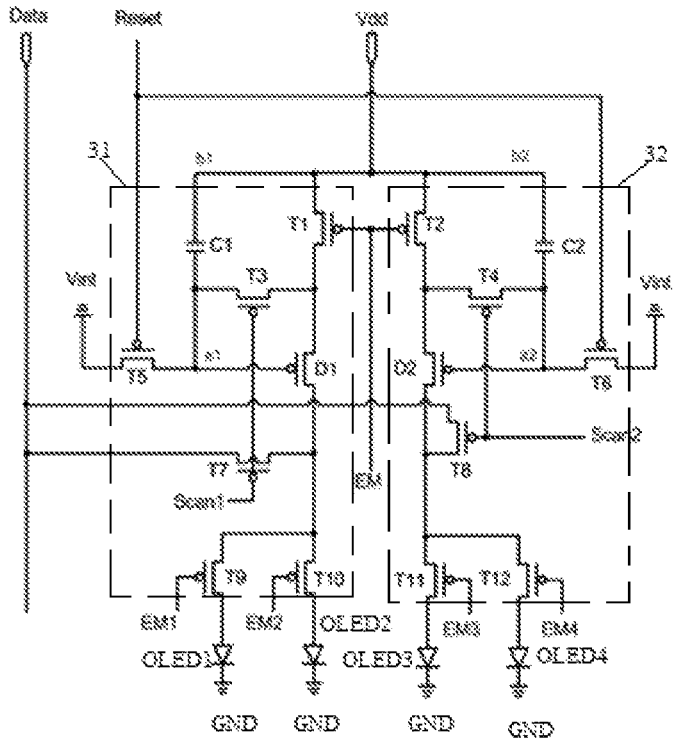
FIG. 3A is a circuit diagram of a pixel driving unit of the pixel driving circuit according to one embodiment of the present disclosure.

As shown in FIG. 3A, the pixel driving unit of the pixel driving circuit includes a first pixel driving sub-unit 31 and a second pixel driving sub-unit 32 connected to a same data line Data.

The first pixel driving sub-unit 31 includes a first driving transistor D1, a first resetting sub-module, a first charging/discharging sub-module, a first compensation sub-module, a first driving control sub-module and a first light-emission control sub-module.

The second pixel driving sub-unit 32 includes a second driving transistor D2, a second resetting sub-module, a second charging/discharging sub-module, a second compensation sub-module, a second driving control sub-module and a second light-emission control sub-module.

The pixel driving unit in FIG. 3A includes 12 transistors, i.e., T1 to T12, a first storage capacitor C1 and a second storage capacitor C2.

The first charging/discharging sub-module includes the first storage capacitor C1, a first end of which is connected to the high level output end for outputting Vdd.

The first resetting sub-module includes a fifth transistor T5, a gate electrode of which is connected to the resetting end Reset, a source electrode of which is connected to a second end of the first storage capacitor C1, and a drain electrode of which is configured to receive an initial voltage Vint.

The first compensation sub-module includes: a third transistor T3, a gate electrode of which is connected to a first scanning line Scan1, a source electrode of which is connected to a source electrode of D1, and a drain electrode of which is connected to the data line Data; and a seventh transistor T7, a gate electrode of which is connected to the first scanning line Scan1, and a source electrode of which is connected to a drain electrode of D1.

The first driving sub-module includes a first transistor T1, a gate electrode of which is connected to the driving control line EM, a source electrode of which is connected to the high level output end for outputting Vdd, and a drain electrode of which is connected to the source electrode of D1.

The first light-emission control sub-module includes: a ninth transistor T9, a gate electrode of which is connected to the first light-emission control line EM1, a source electrode of which is connected to the drain electrode of D1, and a drain electrode of which is connected to the anode of the first OLED OLED1; and a tenth transistor T10, a gate electrode of which is connected to the second light-emission control line EM2, a source electrode of which is connected to the drain electrode of D1, and a drain electrode of which is connected to the anode of the second OLED OLED2.

The second charging/discharging sub-module includes the second storage capacitor C2, a first end of which is connected to the high level output end for outputting Vdd.

The second resetting sub-module includes a sixth transistor T6, a gate electrode of which is connected to the resetting end Reset, a source electrode of which is connected to a second end of the second storage capacitor C2, and a drain electrode of which is configured to receive the initial voltage Vint.

The second compensation sub-module includes: a fourth transistor T4, a gate electrode of which is connected to the second scanning line Scan2, a source electrode of which is connected to the source electrode of D2, and a drain electrode of which is connected to the data line Data; and an eighth transistor T8, a gate electrode of which is connected to the second scanning line Scan2, and a source electrode of which is connected to the drain electrode of D2.

The second driving sub-module includes a second transistor T2, a gate electrode of which is connected to the driving control line EM, a source electrode of which is connected to the high level output end for outputting Vdd, and a drain electrode of which is connected to the source electrode of D2.

The second light-emission control sub-module includes: an eleventh transistor T11, a gate electrode of which is connected to the third light-emission control line EM3, a source electrode of which is connected to the drain electrode of D2, and a drain electrode of which is connected to an anode of the third OLED OLED3; and a twelfth transistor T12, a gate electrode of which is connected to the fourth light-emission control line EM4, a source electrode of which is connected to the drain electrode of D2, and a drain electrode of which is connected to an anode of the fourth OLED OLED4.

Cathodes of OLED1, OLED2, OLED3 and OLED4 are connected to the grounding end GND.

Figure 3B:
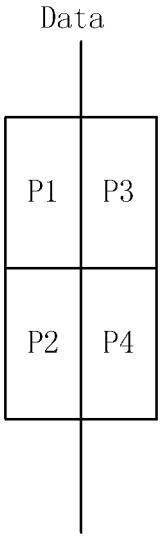
FIG. 3B is a schematic view showing positions P1, P2, P3 and P4.

OLED1 is an OLED of a first pixel P1 in a first row and a first column, OLED2 is an OLED of a second pixel P2 in a second row and the first column, OLED3 is an OLED of a third pixel P3 in the first row and a second column, and OLED4 is an OLED of a fourth pixel P4 in the second row and the second column. FIG. 3B shows positions of P1, P2, P3 and P4.

In FIG. 3A, the gate electrode of D1 is connected to a first node a1, the gate electrode of D2 is connected to a second node a2, the first end of C1 is connected to a third node b1, and the first end of C2 is connected to a fourth node b2.

In FIG. 3A, all the transistors are p-type transistors. However, in actual use, the transistors may also be n-type transistors, and the types of the transistors will not be particularly defined herein.

Figure 4:
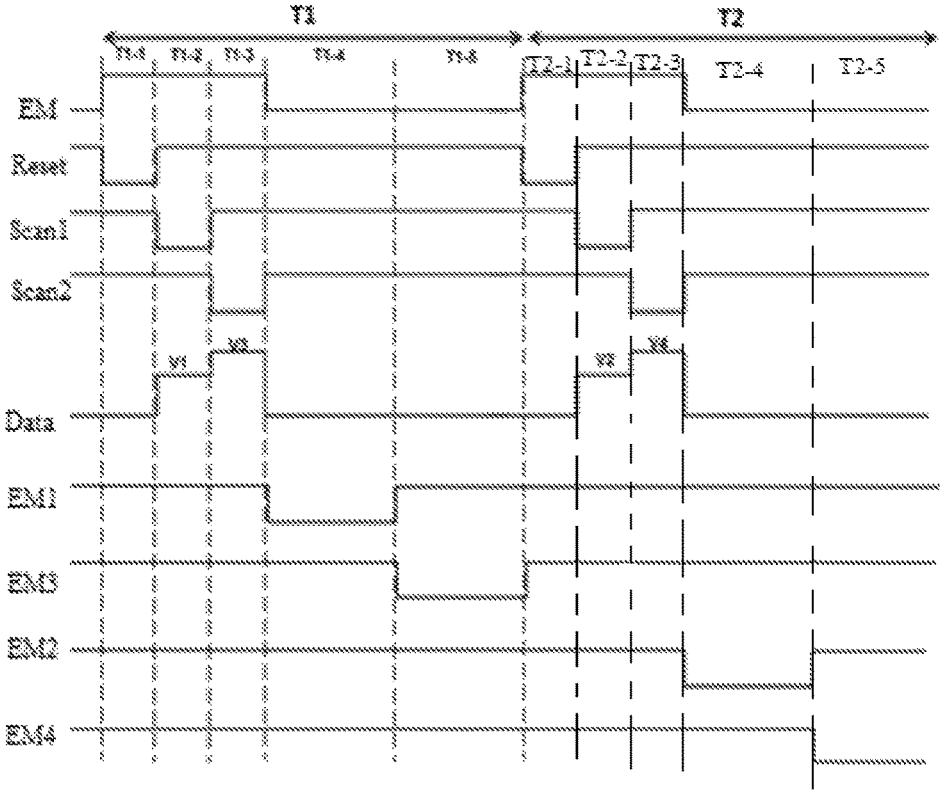
FIG. 4 is a time sequence diagram of the pixel driving unit in FIG. 3A in a high resolution display mode according to one embodiment of the present disclosure.
Figure 5A:
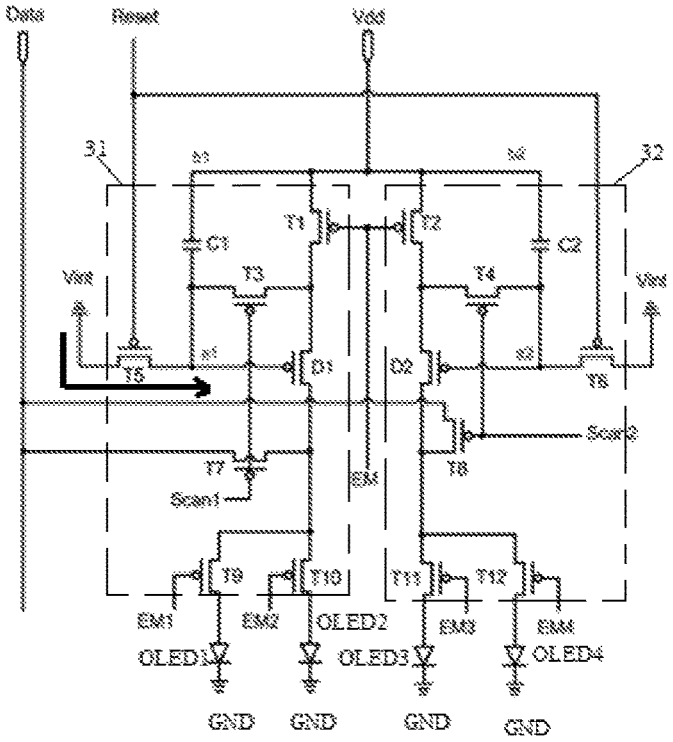
FIG. 5A is a schematic view showing a current direction of T1-1 in FIG. 4 for the pixel driving unit in FIG. 3A according to one embodiment of the present disclosure.

As shown in FIG. 4, in a high resolution display mode, within a first time period T1, as shown in FIG. 5A, at a first resetting stage T1-1, Reset outputs a low level, so as to turn on T5 and T6. Each of the other signal lines outputs a high level, so as to turn off the other transistors. Vint is applied to a1 and a2.

Figure 5B:
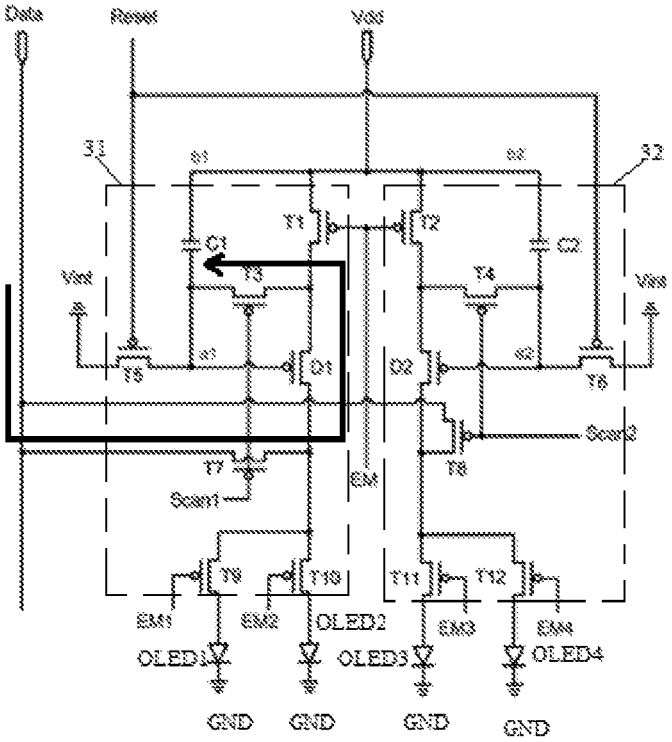
FIG. 5B is a schematic view showing a current direction of T1-2 in FIG. 4 for the pixel driving unit in FIG. 3A according to one embodiment of the present disclosure.

As shown in FIG. 5B, at a first compensation stage T1-2, i.e., a first pixel charging stage, Scan1 outputs a low level, so as to turn on T3 and T7, thereby to charge the first pixel P1 along a path as shown in FIG. 5B. At this time, Data outputs a first data voltage V1, so after the charging operation, a potential at a1 is V1+Vth1, and a potential at b1 is Vdd, where Vth1 represents of the threshold voltage of D1. In FIG. 3A, D1 is a p-type transistor, so Vth1 is smaller than 0.

Figure 5C:
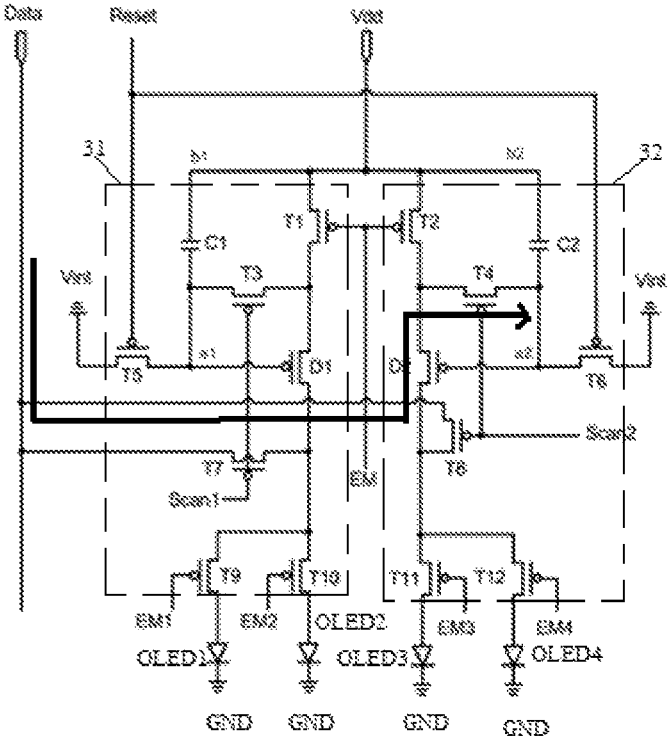
FIG. 5C is a schematic view showing a current direction of T1-3 in FIG. 4 for the pixel driving unit in FIG. 3A according to one embodiment of the present disclosure.

As shown in FIG. 5C, at a second compensation stage T1-3, i.e., a third pixel charging stage, Scan2 outputs a low level, so as to turn on T4 and T8. At this time, Data outputs a third data voltage V3, so after the charging operation, a potential at a2 is V3+Vth2, and a potential at b2 is Vdd, where Vth2 represents the threshold voltage of D2. In FIG. 3A, D2 is a p-type transistor, so Vth2 is smaller than 0.

Figure 5D:
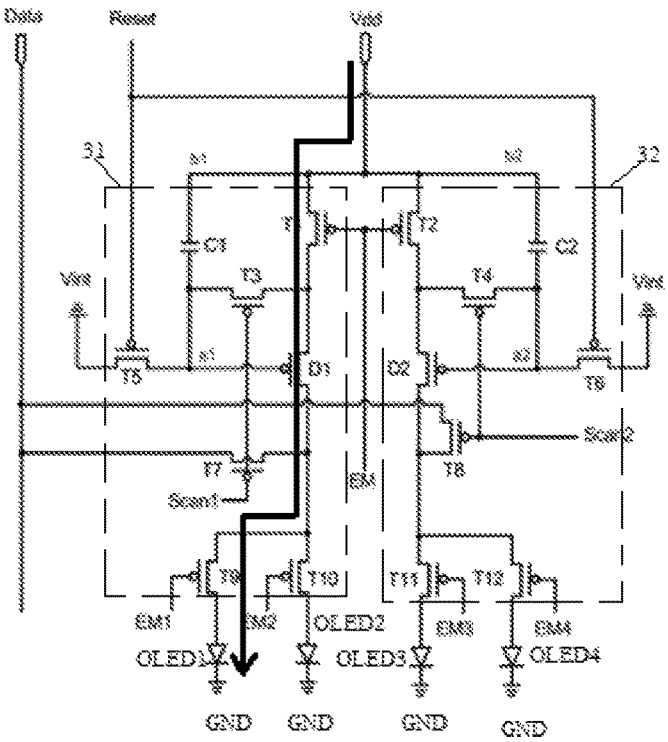
FIG. 5D is a schematic view showing a current direction of T1-4 in FIG. 4 for the pixel driving unit in FIG. 3A according to one embodiment of the present disclosure.

As shown in FIG. 5D, at a first pixel light-emission stage T1-4 (i.e., a P1 light-emission stage), each of EM and EM1 outputs a low level, and the source electrode of D1 is configured to receive VDD, so D1 drives OLED1 to emit light. In accordance with a saturation current equation, a current $I_{OLED1}$ flowing through OLED1 may be calculated through the following equation: $I_{OLED1}=K1*(V_{GS1}-V_{th1})^2=K1*[Vdd-(V1-Vth1)-Vth1]^2=K1*(Vdd-V1)^2$, where K1 represents a current coefficient of D1, and $V_{GS1}$ represents a gate-to-source voltage of D1 at T1-4.

As can be seen from the above equation, $I_{OLED1}$ is merely related to V1 but irrelevant to Vth1. As a result, it is able to prevent an operating current of the OLED from being adversely affected due to the drift of the threshold voltage of the driving TFT caused by a manufacture process or long-term operation, thereby to ensure the normal operation of OLED1.

Figure 5E:
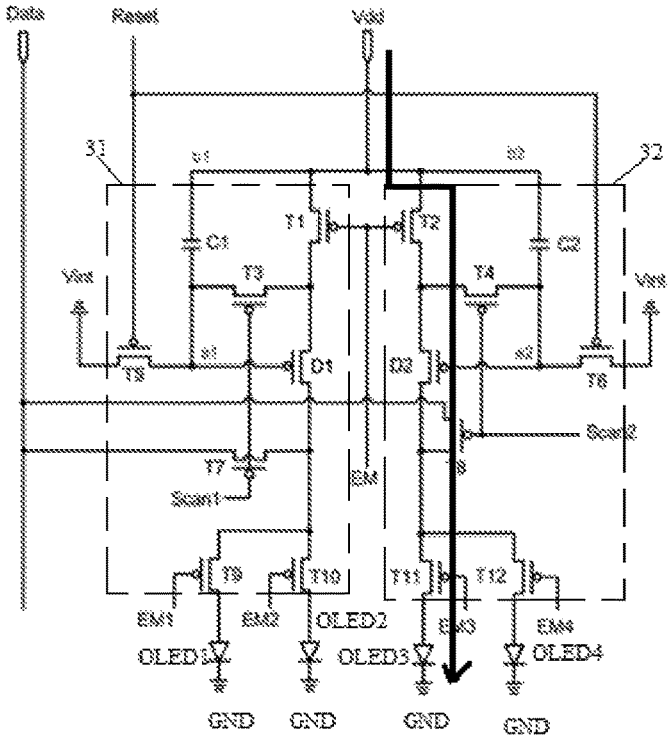
FIG. 5E is a schematic view showing a current direction of T1-5 in FIG. 4 for the pixel driving unit in FIG. 3A according to one embodiment of the present disclosure.

As shown in FIG. 5E, at a third pixel light-emission stage T1-5 (i.e., a P3 light-emission stage), each of EM and EM3 outputs a low level, and the source electrode of D2 is configured to receive Vdd, so D2 drives OLED3 to emit light. In accordance with the saturation current equation, a current $I_{OLED3}$ flowing through OLED3 may be calculated through the following equation: $I_{OLED3}=K2*(V_{GS2}-V_{th2})^2=K2*[Vdd-(V3-Vth2)-Vth2]^2=K2*(Vdd-V3)^2$, where K2 represents a current coefficient of D2, and $V_{GS2}$ represents a gate-to-source voltage of D2 at T1-5.

As can be seen from the above equation, $I_{OLED3}$ is merely related to V3 but irrelevant to Vth2. As a result, it is able to prevent an operating current of the OLED from being adversely affected due to the drift of the threshold voltage of the driving TFT caused by a manufacture process or long-term operation, thereby to ensure the normal operation of OLED3.

As shown in FIG. 4, within a second time period T2, at a second resetting stage T2-1, Reset outputs a low level, so as to turn on T5 and T6. Each of the other signal lines outputs a high level, so as to turn off the other transistors. Vint is applied to a1 and a2.

At a third compensation stage T2-2, i.e., a second pixel charging stage, Scan2 outputs a low level, so as to turn on T4 and T8, thereby to charge the second pixel P2. At this time, Data outputs a second data voltage V2, so after the charging operation, a potential at a1 is V2+Vth1, and a potential at b1 is Vdd, where Vth1 represents the threshold voltage of D1. In FIG. 3A, D1 is a p-type transistor, so Vth1 is smaller than 0.

At a fourth compensation stage T2-3, i.e., a fourth pixel charging stage, Scan2 outputs a low level, so as to turn on T4 and T8. At this time, Data outputs a fourth data voltage V4, so after the charging operation, a potential at a2 is V4+Vth2, and a potential at b2 is Vdd, where Vth2 represents the threshold voltage of D2. In FIG. 3A, D2 is a p-type transistor, so Vth2 is smaller than 0.

Figure 5F:
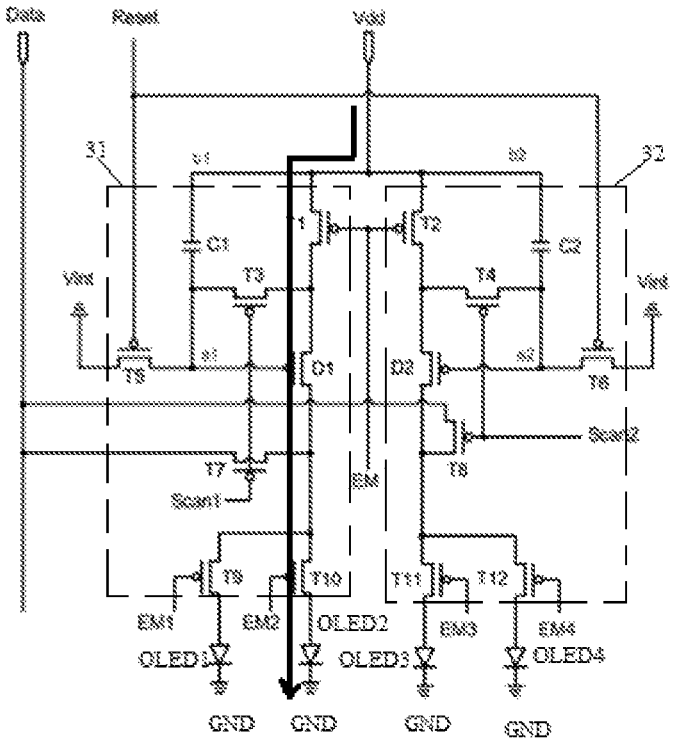
FIG. 5F is a schematic view showing a current direction of T2-4 in FIG. 4 for the pixel driving unit in FIG. 3A according to one embodiment of the present disclosure.

As shown in FIG. 5F, at a second pixel light-emission stage T2-4 (i.e., a P2 light-emission stage), each of EM and EM2 outputs a low level, and the source electrode of D2 is configured to receive Vdd, so D1 drives OLED2 to emit light. In accordance with the saturation current equation, a current IOLED2 flowing through OLED2 may be calculated through the following equation: $I_{OLED2}=K1*(V_{GS3}-V_{th1})^2=K1*[Vdd-(V2-Vth1)-Vth1]^2=K1*(Vdd-V2)^2$, where K1 represents a current coefficient of D1, and $V_{GS3}$ represents a gate-to-source voltage of D1 at T2-4.

As can be seen from the above equation, $I_{OLED2}$ is merely related to V2 but irrelevant to Vth1. As a result, it is able to prevent an operating current of the OLED from being adversely affected due to the drift of the threshold voltage of the driving TFT caused by a manufacture process or long-term operation, thereby to ensure the normal operation of OLED2.

Figure 5G:
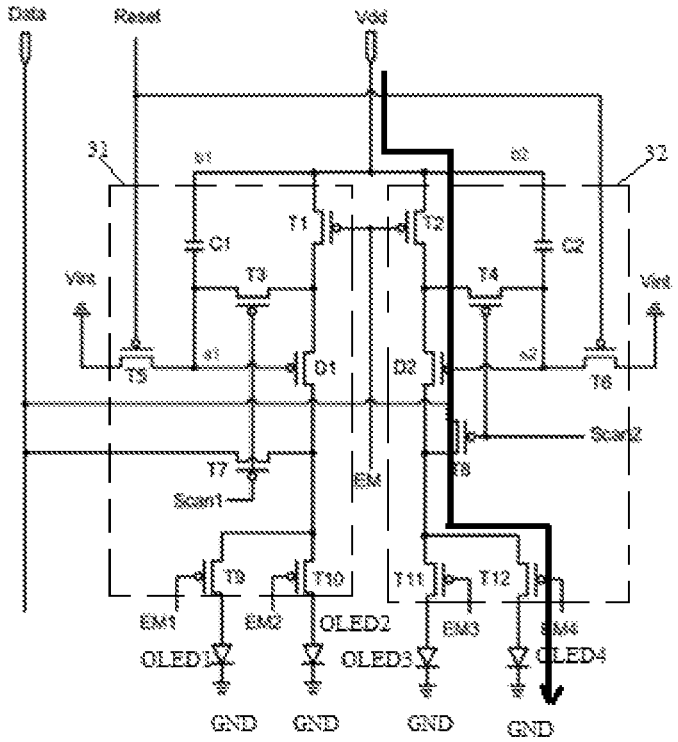
FIG. 5G is a schematic view showing a current direction of T2-5 in FIG. 4 for the pixel driving unit in FIG. 3A according to one embodiment of the present disclosure.

As shown in FIG. 5G, at a fourth pixel light-emission stage T2-5 (i.e., a P4 light-emission stage), each of EM and EM4 outputs a low level, and the source electrode of D2 is configured to receive Vdd, so D2 drives OLED4 to emit light. In accordance with the saturation current equation, a current $I_{OLED4}$ flowing through OLED4 may be calculated through the following equation: $I_{OLED4}=K2*(V_{G}s4-V_{th2})^2=K2*[Vdd-(V4-Vth2)-Vth2]^2=K2*(Vdd-V4)^2$, where K2 represents a current coefficient of D2, and $V_{GS4}$ represents a gate-to-source voltage of D2 at T2-5.

As can be seen from the above equation, $I_{OLED4}$ is merely related to V4 but irrelevant to Vth1. As a result, it is able to prevent an operating current of the OLED from being adversely affected due to the drift of the threshold voltage of the driving TFT caused by a manufacture process or long-term operation, thereby to ensure the normal operation of OLED4.

As mentioned above, when the pixel driving circuit is in the high resolution display mode, within the first time period T1, the first pixel P1 may emit light in accordance with V1, and then the third pixel P3 may emit light in accordance with V3. Within the second time period T2, the second pixel P2 may emit light in accordance with V2, and the fourth pixel P4 may emit light in accordance with V4.

Figure 6:
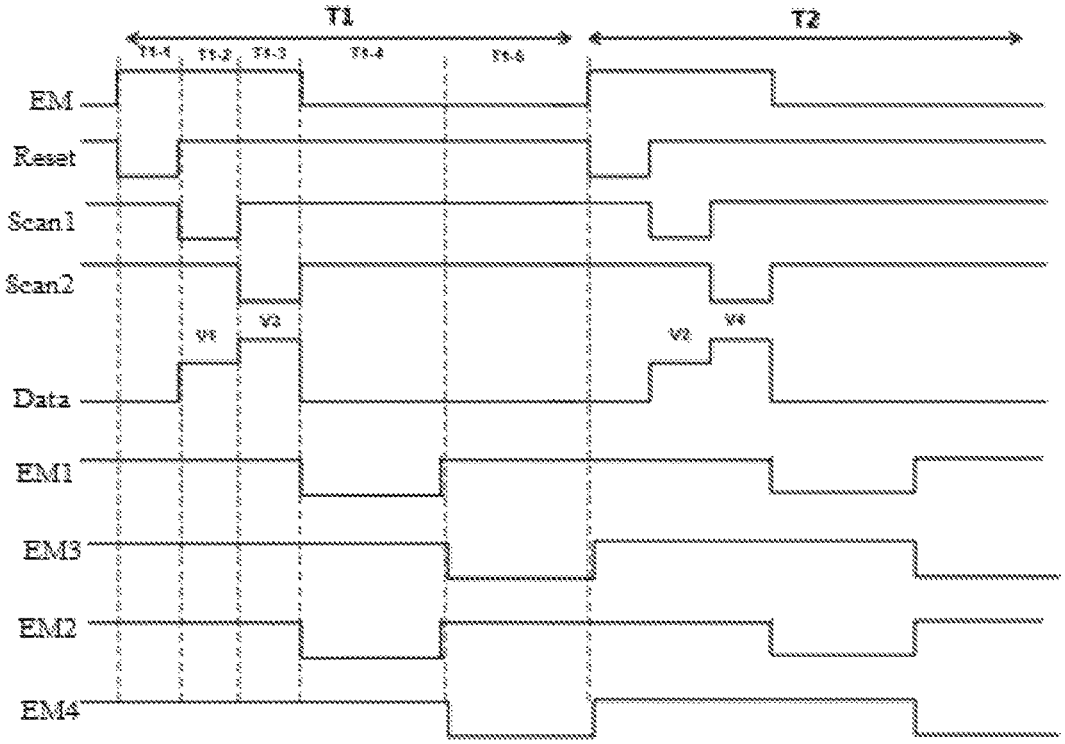
FIG. 6 is another time sequence diagram of the pixel driving unit in FIG. 3A is a low resolution display mode according to one embodiment of the present disclosure.

As shown in FIG. 6, in the low resolution display mode, the resetting and charging procedures are the same with those in the high resolution display mode. During the display, within the first time period T1, one light-emission control signal is applied to EM1 and EM2 simultaneously, and another light-emission control signal is applied to EM3 and EM4 simultaneously. Within the second time period T2, one light-emission control signal is applied to EM1 and EM2 simultaneously, and another light-emission control signal is applied to EM3 and EM4 simultaneously. As a result, two light-emission control lines may not be inputted by the light-emission control signal, thereby to reduce the power consumption.

Figure 7A:
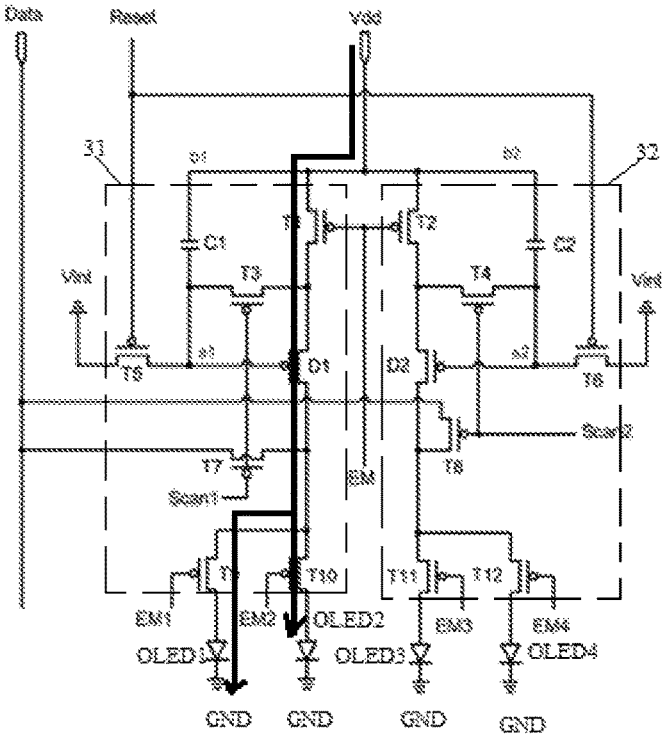
FIG. 7A is a schematic view showing a current direction for the pixel driving unit in FIG. 3A when driving OLED1 and OLED2 to emit light simultaneously in the low resolution display mode according to one embodiment of the present disclosure.
Figure 7B:
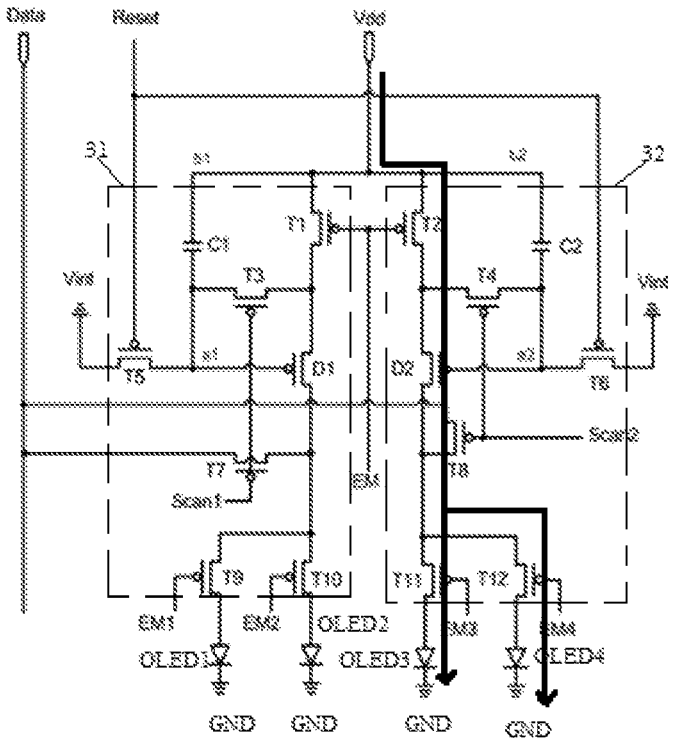
FIG. 7B is a schematic view showing a current direction for the pixel driving unit in FIG. 3A when driving OLED3 and OLED4 to emit light simultaneously in the low resolution display mode according to one embodiment of the present disclosure.

FIG. 7A is a circuit diagram of the pixel driving circuit in the low resolution display mode when OLED1 and OLED2 emit light simultaneously, and FIG. 7B is a circuit diagram of the pixel driving circuit in the low resolution display mode when OLED3 and OLED4 emit light simultaneously.

Figure 8:
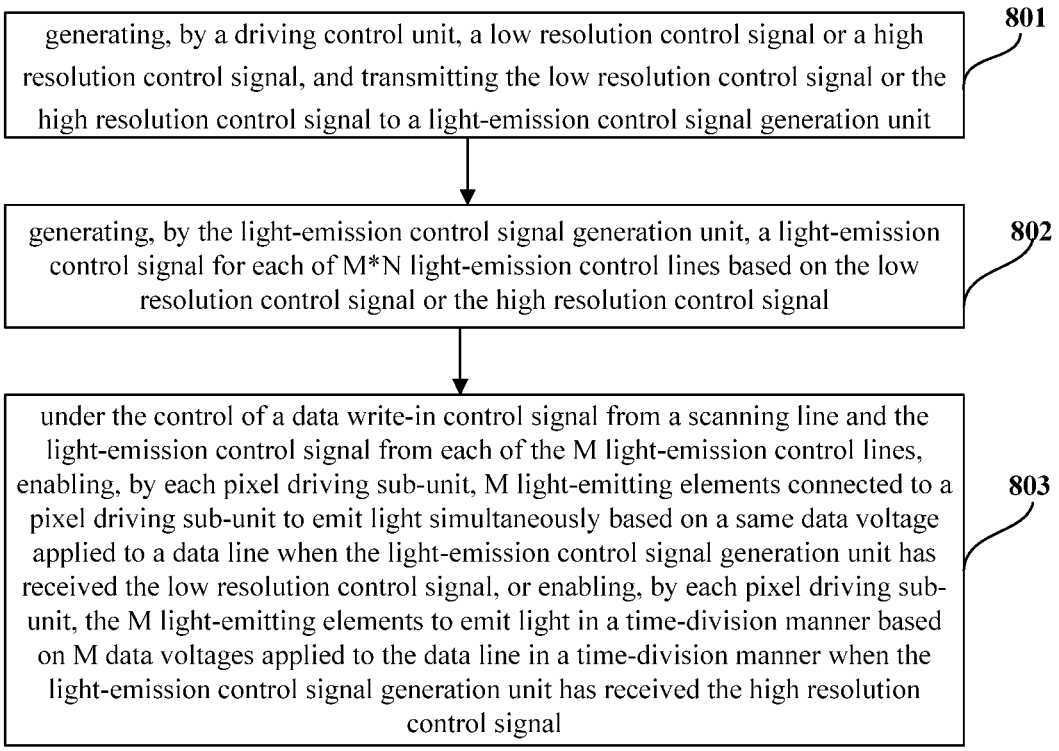
FIG. 8 is a flow chart of a method for driving the pixel driving circuit according to one embodiment of the present disclosure.

The present disclosure further provides in some embodiments a method for driving the above-mentioned pixel driving circuit which, as shown in FIG. 8, includes: Step 801 of generating, by the driving control unit, a low resolution control signal or a high resolution control signal, and transmitting the low resolution control signal or the high resolution control signal to the light-emission control signal generation unit; Step 802 of generating, by the light-emission control signal generation unit, a corresponding light-emission control signal for each of M*N light-emission control lines in accordance with the low resolution control signal or the high resolution control signal; and Step 803 of, under the control of a data write-in control signal from a scanning line and the light-emission control signal from each of the M light-emission control lines, when the light-emission control signal generation unit has received the low resolution control signal, enabling, by each of the pixel driving sub-units, the M light-emitting elements connected to the pixel driving sub-unit to emit light simultaneously in accordance with a same data voltage applied to the data line, or when the light-emission control signal generation unit has received the high resolution control signal, enabling, by each of the pixel driving sub-units, the M light-emitting elements to emit light in a time-division manner in accordance with M data voltages applied to the data line in a time-division manner.

In a possible embodiment of the present disclosure, the method for driving the above-mentioned pixel driving circuit includes: a display control signal generation step of generating, by the driving control unit of the pixel driving circuit, the low resolution control signal or the high resolution control signal in accordance with an external distance, the external distance being a distance between a human eye and a display panel; a light-emission control signal generation step of generating, by the light-emission control signal generation unit of the pixel driving circuit, a corresponding light-emission control signal for each of M*N light-emission control lines in accordance with the low resolution control signal or the high resolution control signal; and a display driving step of, under the control of a data write-in control signal from a scanning line and the light-emission control signal from each of the M light-emission control lines, when the light-emission control signal generation unit has received the low resolution control signal, enabling, by each pixel driving sub-unit of the pixel driving unit, the M light-emitting elements connected to the pixel driving sub-unit to emit light simultaneously in accordance with a same data voltage applied to the data line, or when the light-emission control signal generation unit has received the high resolution control signal, enabling, by each pixel driving sub-unit of the pixel driving unit, the M light-emitting elements to emit light in a time-division manner in accordance with M data voltages applied to the data line in a time-division manner, where N and M are both integers greater than 1.

In a possible embodiment of the present disclosure, the display control signal generation step further includes: generating, by the driving control unit, the low resolution control signal or the high resolution control signal in accordance with a distance between a human eye and a display panel; when the distance is greater than or equal to a predetermined distance, transmitting, by the driving control unit, the low resolution control signal to the pixel driving unit; and when the distance is smaller than the predetermined distance, transmitting, by the driving control unit, the high resolution control signal to the pixel driving unit.

To be specific, when each pixel driving sub-unit includes a driving transistor and a pixel driving control module connected to each other and the driving transistor is connected to the M light-emitting elements through the pixel driving control module, the display driving step includes: when the light-emission control signal generation unit has received the low resolution control signal, under the control of the data write-in control signal from the scanning line and the light-emission control signal from each of the M light-emission control lines, enabling, by the pixel driving control module, the driving transistor to drive the M light-emitting elements connected to the pixel driving sub-unit to emit light simultaneously in accordance with a same data voltage applied to the data line and compensate for a threshold voltage of the driving transistor with a gate-to-source voltage of the driving transistor; or when the light-emission control signal generation unit has received the high resolution control signal, under the control of the data write-in control signal from the scanning line and the light-emission control signal from each of the M light-emission control lines, enabling, by the pixel driving control module, the driving transistor to drive the M light-emitting elements to emit light in a time-division manner in accordance with M data voltages applied to the data line in a time-division manner and compensate for the threshold voltage of the driving transistor with the gate-to-source voltage of the driving transistor.

To be specific, each display period includes M display sub-periods. An $n^{th}$ pixel driving control module includes a resetting sub-module, an $n^{th}$ charging/discharging sub-module, an $n^{th}$ compensation sub-module, an $n^{th}$ driving control sub-module and an $n^{th}$ light-emission control sub-module. When the light-emission control signal generation unit has received the high resolution control signal, each display sub-period includes a resetting stage, a compensation stage and a light-emission stage. The compensation stage includes N compensation time periods, and the light-emission stage includes N light-emission time periods. Within an $m^{th}$ display sub-period, the display driving step may include: a resetting step of, at the resetting stage, enabling, by the resetting sub-module, a gate electrode of a corresponding driving transistor to receive a corresponding start signal under the control of the resetting control signal from the resetting end; a compensation step of, within an $n^{th}$ compensation time period of the compensation stage, under the control of an $n^{th}$ data write-in control signal from the $n^{th}$ scanning line, applying, by the $n^{th}$ compensation sub-module, the data voltage from the data line to the second electrode of the $n^{th}$ driving transistor, and enabling the gate electrode of the $n^{th}$ driving transistor to be electrically connected to the first electrode of the $n^{th}$ driving transistor, so as to charge or discharge the $n^{th}$ charging/discharging sub-module until a potential at the gate electrode of the $n^{th}$ driving transistor is equal to a sum of the data voltage and the threshold voltage of the $n^{th}$ driving transistor; and a light-emission stage of, within an $n^{th}$ light-emission time period of the light-emission stage, enabling, by the $n^{th}$ driving control sub-module, the first electrode of the $n^{th}$ driving transistor to be electrically connected to the high level output end under the control of the driving control signal from the driving control line, and under the control of an $m^{th}$ light-emission control signal from an $m^{th}$ light-emission control line, enabling, by the $n^{th}$ light-emission control sub-module, the $n^{th}$ driving transistor to drive an $m^{th}$ light-emitting element connected to the $n^{th}$ pixel driving control module to emit light in accordance with the data voltage, and compensating for the threshold voltage of the $n^{th}$ driving transistor with the gate-to-source voltage of the $n^{th}$ driving transistor, where n is a positive integer smaller than or equal to N, and m is an integer smaller than or equal to M.

To be specific, each display period includes M display sub-periods. Each display sub-period includes a resetting stage, a compensation stage and a light-emission stage. An $n^{th}$ pixel driving control module includes a resetting sub-module, an $n^{th}$ charging/discharging sub-module, an $n^{th}$ compensation sub-module, an $n^{th}$ driving control sub-module and an $n^{th}$ light-emission control sub-module. When the light-emission control signal generation unit has received the low resolution control signal, each display sub-period includes a resetting stage, a compensation stage and a light-emission stage in turns. The compensation stage includes N compensation time periods, and the light-emission stage includes N light-emission time periods. Within an $m^{th}$ display sub-period, the display driving step may include: a resetting step of, at the resetting stage, enabling, by the resetting sub-module, a gate electrode of a corresponding driving transistor to receive a corresponding start signal under the control of the resetting control signal from the resetting end; a compensation step of, within an $n^{th}$ compensation time period of the compensation stage, under the control of an $n^{th}$ data write-in control signal from the $n^{th}$ scanning line, applying, by the $n^{th}$ compensation sub-module, the data voltage from the data line to the second electrode of the $n^{th}$ driving transistor, and enabling the gate electrode of the $n^{th}$ driving transistor to be electrically connected to the first electrode of the $n^{th}$ driving transistor, so as to charge or discharge the $n^{th}$ charging/discharging sub-module until a potential at the gate electrode of the $n^{th}$ driving transistor is equal to a sum of the data voltage and the threshold voltage of the $n^{th}$ driving transistor; and a light-emission step of, within an $n^{th}$ light-emission time period of the light-emission stage, enabling, by the $n^{th}$ driving control sub-module, the first electrode of the $n^{th}$ driving transistor to be electrically connected to the high level output end under the control of the driving control signal from the driving control line, and under the control of the M light-emission control signals from the M light-emission control lines, enabling, by the $n^{th}$ light-emission control sub-module, the M light-emitting elements connected to the $n^{th}$ pixel driving control module to emit light simultaneously in accordance with the data voltage, and compensating for the threshold voltage of the $n^{th}$ driving transistor with the gate-to-source voltage of the $n^{th}$ driving transistor, where n is a positive integer smaller than or equal to N, and m is an integer smaller than or equal to M.

The present disclosure further provides in some embodiments a display device including a display panel and the above-mentioned pixel driving circuit.

To be specific, the display device may further include a human eye detection unit connected to a driving control unit of the pixel driving circuit and configured to detect a distance between a human eye and the display panel and transmit the distance to the driving control unit. The driving control unit is configured to, when the distance is greater than or equal to a predetermined distance, transmit a low resolution control signal to the pixel driving unit, and when the distance is smaller than the predetermined distance, transmit a high resolution control signal to the pixel driving unit.

The pixel driving circuit may be a silicon-based OLED back plate driving circuit with a Smart View display mode.

According to the embodiments of the present disclosure, based on the silicon-based OLED display technology, it is able to adjust the resolution with respect to a region capable of being viewed by the human eye, thereby to reduce the power consumption. In addition, every two adjacent single-pixel compensation units known in the art may share a same data line (i.e., two compensation circuits are controlled by one data line), so it is able to reduce the number of the compensation TFTs, thereby to remarkably reduce the Pixel Pitch and acquire higher image quality and higher PPI.

In addition, through the detection unit, it is able to accurately determine a position of the human eye and the distance between the human eye and the display panel. When the human eye is close to the display panel, the display panel may be in a high resolution mode, and when the human eye is far away from the display panel, the display panel may be in a low resolution mode. As a result, it is able to selectively switch the resolution, thereby to effectively reduce the power consumption of the display panel.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel driving circuit, comprising a driving control unit, a light-emission control signal generation unit and a pixel driving unit, wherein the pixel driving unit comprises N pixel driving sub-units connected to a same data line;

the driving control unit is configured to generate a low resolution control signal or a high resolution control signal;

the light-emission control signal generation unit is connected to the driving control unit and M*N light-emission control lines and configured to generate a corresponding light-emission control signal for each of the M*N light-emission control lines based on the low resolution control signal or the high resolution control signal;

each of the pixel driving sub-units is connected to M light-emitting elements, a scanning line and M light-emission control lines and configured to, under the control of a data write-in control signal from the scanning line and the light-emission control signals from the M light-emission control lines, when the light-emission control signal generation unit has received the low resolution control signal, control the M light-emitting elements connected to the pixel driving sub-unit to emit light simultaneously based on a same data voltage applied to the data line, and when the light-emission control signal generation unit has received the high resolution control signal, control the M light-emitting elements to emit light in a time-division manner based on the M data voltages applied to the data line in a time-division manner; and N and M are both integers greater than 1.

2. The pixel driving circuit according to claim 1, wherein each pixel driving sub-unit comprises a driving transistor and a pixel driving control module connected to each other;

the driving transistor is connected to the M light-emitting elements through the pixel driving control module; and the pixel driving control module is connected to the scanning line and the M light-emission control lines and configured to, under the control of the data write-in control signal from the scanning line and the light-emission control signals from the M light-emission control lines, when the light-emission control signal generation unit has received the low resolution control signal, enable the driving transistor to drive the M light-emitting elements connected to the pixel driving sub-unit to emit light simultaneously based on a same data voltage applied to the data line, and when the light-emission control signal generation unit has received the high resolution control signal, enable, in a time-division manner, the driving transistor to drive the M light-emitting elements to emit light in a time-division manner based on M data voltages applied to the data line in a time-division manner.

3. The pixel driving circuit according to claim 2, wherein an $n^{th}$ pixel driving control module comprises:

an $n^{th}$ resetting sub-module connected to a resetting end, an $n^{th}$ start signal output end and a gate electrode of an $n^{th}$ driving transistor and configured to enable the $n^{th}$ start signal output end to be electrically connected to the gate electrode of the $n^{th}$ driving transistor under the control of a resetting control signal from the resetting end;

an $n^{th}$ charging/discharging sub-module, a first end of which is connected to a voltage output end, and a second end of which is connected to the gate electrode of the $n^{th}$ driving transistor;

an $n^{th}$ compensation sub-module connected to an $n^{th}$ scanning line, the data line, the gate electrode of the $n^{th}$ driving transistor, and a first electrode and a second electrode of the $n^{th}$ driving transistor, and configured to, under the control of an $n^{th}$ data write-in control signal from the $n^{th}$ scanning line, apply the data voltage from the data line to the second electrode of the $n^{th}$ driving transistor and enable the gate electrode of the $n^{th}$ driving transistor to be electrically connected to the first electrode of the $n^{th}$ driving transistor, so as to charge or discharge the $n^{th}$ charging/discharging sub-module;

an $n^{th}$ driving control sub-module connected to a driving control line, a high level output end and the first electrode of the $n^{th}$ driving transistor, and configured to, under the control of a driving control signal from the driving control line, enable the first electrode of the $n^{th}$ driving transistor to be electrically connected to the high level output end; and an $n^{th}$ light-emission control sub-module connected to the M light-emitting elements and M light-emission control lines, and configured to, under the control of the light-emission control signals from the M light-emission control lines, when the light-emission control signal generation unit has received the low resolution control signal, enable the $n^{th}$ driving transistor to drive the M light-emitting elements connected to the pixel driving sub-unit to emit light simultaneously based on a same data voltage applied to the data line, and when the light-emission control signal generation unit has received the high resolution control signal, enable, in a time-division manner, the $n^{th}$ driving transistor to drive the M light-emitting elements to emit light in a time-division manner based on M data voltages applied to the data line in a time-division manner, where n is a positive integer greater than or equal to 1 and smaller than or equal to N.

4. The pixel driving circuit according to claim 3, wherein the $n^{th}$ compensation sub-module comprises:

a first compensation transistor, a gate electrode of which is connected to the $n^{th}$ scanning line, a first electrode of which is connected to the data line, and a second electrode of which is connected to the second electrode of the $n^{th}$ driving transistor; and a second compensation transistor, a gate electrode of which is connected to the $n^{th}$ scanning line, a first electrode of which is connected to the gate electrode of the $n^{th}$ driving transistor, and a second electrode of which is connected to the first electrode of the $n^{th}$ driving transistor.

5. The pixel driving circuit according to claim 3, wherein the $n^{th}$ driving control sub-module comprises an $n^{th}$ driving control transistor, a gate electrode of which is connected to the driving control line, a first electrode of which is connected to the high level output end, and a second electrode of which is connected to the first electrode of the $n^{th}$ driving transistor;

the $n^{th}$ light-emission control sub-module comprises M light-emission control transistors; and a gate electrode of each light-emission control transistor is connected to one of the light-emission control lines, a first electrode of the light-emission control transistor is connected to the second electrode of the $n^{th}$ driving transistor, and a second electrode of the light-emission control transistor is connected to one of the light-emitting elements.

6. The pixel driving circuit according to claim 3, wherein the resetting sub-module comprises a resetting transistor, a gate electrode of which is connected to the resetting end, a first electrode of which is connected to the $n^{th}$ start signal output end, and a second electrode of which is connected to the gate electrode of the $n^{th}$ driving transistor; and the $n^{th}$ charging/discharging sub-module comprises an $n^{th}$ storage capacitor, a first end of which is connected to a voltage output end, and a second end of which is connected to the gate electrode of the $n^{th}$ driving transistor.

7. The pixel driving circuit according to claim 3, wherein when the $n^{th}$ driving transistor is a p-type transistor, a difference between an $n^{th}$ start signal from the $n^{th}$ start signal output end and a data voltage outputted by the data line under the control of the $n^{th}$ data write-in control signal from the $n^{th}$ scanning line is smaller than a threshold voltage of the $n^{th}$ driving transistor.

8. The pixel driving circuit according to claim 3, wherein when the $n^{th}$ driving transistor is an n-type transistor, a difference between an $n^{th}$ start signal from the $n^{th}$ start signal output end and a data voltage outputted by the data line under the control of the $n^{th}$ data write-in control signal from the $n^{th}$ scanning line is greater than or equal to a threshold voltage of the $n^{th}$ driving transistor.

9. The pixel driving circuit according to claim 3, wherein when the $n^{th}$ charging/discharging sub-module stops to be charged or discharged, a potential at the gate electrode of the $n^{th}$ driving transistor is equal to a sum of the data voltage and the threshold voltage of the $n^{th}$ driving transistor.

10. The pixel driving circuit according to claim 2, wherein the pixel driving control module is further configured to, when the driving transistor drives the M light-emitting elements connected to the pixel driving sub-unit to emit light simultaneously or in a time-division manner, compensate for the threshold voltage of the driving transistor.

11. The pixel driving circuit according to claim 10, wherein the pixel driving control module is further configured to compensate for the threshold voltage of the driving transistor with a gate-to-source voltage of the driving transistor.

12. The pixel driving circuit according to claim 1, wherein the light-emitting element is an organic light-emitting diode (OLED), an anode of which is connected to the pixel driving sub-unit, and a cathode of which is grounded.

13. The pixel driving circuit according to claim 1, wherein the driving control unit is configured to generate the low resolution control signal or the high resolution control signal based on an external distance, and the external distance is a distance between a human eye and a display panel.

14. A method for driving a pixel driving circuit, wherein the pixel driving circuit comprises a driving control unit, a light-emission control signal generation unit and a pixel driving unit, the light-emission control signal generation unit is connected to the driving control unit and M*N light-emission control lines, the pixel driving unit comprises N pixel driving sub-units connected to a same data line, and each of the pixel driving sub-units is connected to M light-emitting elements, a scanning line and M light-emission control lines, wherein the method comprises:

a display control signal generation step of generating, by the driving control unit, a low resolution control signal or a high resolution control signal, and transmitting the low resolution control signal or the high resolution control signal to the light-emission control signal generation unit;

a light-emission control signal generation step of generating, by the light-emission control signal generation unit, a corresponding light-emission control signal for each of M*N light-emission control lines based on the low resolution control signal or the high resolution control signal; and a display driving step of, under the control of a data write-in control signal from a scanning line and the light-emission control signals from the M light-emission control lines, when the light-emission control signal generation unit has received the low resolution control signal, enabling, by each of the pixel driving sub-units, the M light-emitting elements connected to the pixel driving sub-unit to emit light simultaneously based on a same data voltage applied to the data line, or when the light-emission control signal generation unit has received the high resolution control signal, enabling, by each of the pixel driving sub-units, the M light-emitting elements to emit light in a time-division manner based on M data voltages applied to the data line in a time-division manner, where N and M are both integers greater than 1.

15. The method according to claim 14, wherein each pixel driving sub-unit comprises a driving transistor and a pixel driving control module connected to each other and the driving transistor is connected to the M light-emitting elements through the pixel driving control module, the display driving step comprises:

when the light-emission control signal generation unit has received the low resolution control signal, under the control of the data write-in control signal from the scanning line and the light-emission control signals from the M light-emission control lines, enabling, by the pixel driving control module, the driving transistor to drive the M light-emitting elements connected to the pixel driving sub-unit to emit light simultaneously based on a same data voltage applied to the data line; or when the light-emission control signal generation unit has received the high resolution control signal, under the control of the data write-in control signal from the scanning line and the light-emission control signal from each of the M light-emission control lines, enabling, by the pixel driving control module, the driving transistor to drive the M light-emitting elements to emit light in a time-division manner based on M data voltages applied to the data line in a time-division manner.

16. The method according to claim 15, wherein the display driving step further comprises, when the driving transistor drives the M light-emitting elements connected to the pixel driving sub-unit to emit light simultaneously or in a time-division manner, compensating for a threshold voltage of the driving transistor with a gate-to-source voltage of the driving transistor.

17. The method according to claim 15, wherein an $n^{th}$ pixel driving control module comprises a resetting sub-module, an $n^{th}$ charging/discharging sub-module, an $n^{th}$ compensation sub-module, an $n^{th}$ driving control sub-module and an $n^{th}$ light-emission control sub-module, the $n^{th}$ resetting sub-module is connected to a resetting end, an $n^{th}$ start signal output end and a gate electrode of an $n^{th}$ driving transistor, a first end of the nth charging/discharging sub-module is connected to a voltage output end, and a second end thereof is connected to the gate electrode of the $n^{th}$ driving transistor, the $n^{th}$ compensation sub-module is connected to an $n^{th}$ scanning line, the data line, and the gate electrode, a first electrode and a second electrode of the $n^{th}$ driving transistor, the $n^{th}$ driving control sub-module is connected to a driving control line, a high level output end and the first electrode of the $n^{th}$ driving transistor, where n is an integer greater than or equal to 1 and smaller than or equal to N, wherein the display driving step further comprises:

enabling, by the $n^{th}$ resetting sub-module, the $n^{th}$ start signal output end to be electrically connected to the gate electrode of the $n^{th}$ driving transistor under the control of a resetting control signal from the resetting end;

under the control of an $n^{th}$ data write-in control signal from the $n^{th}$ scanning line, applying, by the $n^{th}$ compensation sub-module, a data voltage from the data line to the second electrode of the $n^{th}$ driving transistor and enabling the gate electrode of the $n^{th}$ driving transistor to be electrically connected to the first electrode of the $n^{th}$ driving transistor, to charge or discharge the $n^{th}$ charging/discharging sub-module;

enabling, by the $n^{th}$ driving control sub-module, the first electrode of the $n^{th}$ driving transistor to be electrically connected to the high level output end under the control of a driving control signal from the driving control line; and under the control of the light-emission control signals from the M light-emission control lines, when the light-emission control signal generation unit has received the low resolution control signal, enabling, by the $n^{th}$ light-emission control sub-module, the $n^{th}$ driving transistor to drive the M light-emitting elements connected to the pixel driving sub-unit to emit light simultaneously based on a same data voltage applied to the data line, or when the light-emission control signal generation unit has received the high resolution control signal, enabling, by the $n^{th}$ light-emission control sub-module, the $n^{th}$ driving transistor to drive the M light-emitting elements to emit light in a time-division manner based on M data voltages applied to the data line in a time-division manner.

18. The method according to claim 17, wherein each display period comprises M display sub-periods, each display sub-period comprises a resetting stage, a compensation stage and a light-emission stage, the compensation stage comprises N compensation time periods, and the light-emission stage comprises N light-emission time periods, wherein the display driving step further comprises, when the light-emission control signal generation unit has received the high resolution control signal, within an $m^{th}$ display sub-period:

at the resetting stage, enabling, by the resetting sub-module, a gate electrode of a corresponding driving transistor to receive a corresponding start signal under the control of the resetting control signal from the resetting end;

within an $n^{th}$ compensation time period of the compensation stage, under the control of an $n^{th}$ data write-in control signal from the $n^{th}$ scanning line, applying, by the $n^{th}$ compensation sub-module, the data voltage from the data line to the second electrode of the $n^{th}$ driving transistor, and enabling the gate electrode of the $n^{th}$ driving transistor to be electrically connected to the first electrode of the $n^{th}$ driving transistor, to charge or discharge the $n^{th}$ charging/discharging sub-module until a potential at the gate electrode of the $n^{th}$ driving transistor is equal to a sum of the data voltage and the threshold voltage of the $n^{th}$ driving transistor; and within an $n^{th}$ light-emission time period of the light-emission stage, enabling, by the $n^{th}$ driving control sub-module, the first electrode of the $n^{th}$ driving transistor to be electrically connected to the high level output end under the control of the driving control signal from the driving control line, and under the control of an $m^{th}$ light-emission control signal from an $m^{th}$ light-emission control line, enabling, by the $n^{th}$ light-emission control sub-module, the $n^{th}$ driving transistor to drive an $m^{th}$ light-emitting element connected to the $n^{th}$ pixel driving control module to emit light based on the data voltage, and compensating for the threshold voltage of the $n^{th}$ driving transistor with the gate-to-source voltage of the $n^{th}$ driving transistor, where m is an integer greater than or equal to 1 and smaller than or equal to M.

19. The method according to claim 17, wherein each display period comprises M display sub-periods, each display sub-period comprises a resetting stage, a compensation stage and a light-emission stage, the compensation stage comprises N compensation time periods, and the light-emission stage comprises N light-emission time periods, wherein the display driving step further comprises, when the light-emission control signal generation unit has received the low resolution control signal, within an $m^{th}$ display sub-period:

at the resetting stage, enabling, by the resetting sub-module, a gate electrode of a corresponding driving transistor to receive a corresponding start signal under the control of the resetting control signal from the resetting end;

within an $n^{th}$ compensation time period of the compensation stage, under the control of an $n^{th}$ data write-in control signal from the $n^{th}$ scanning line, applying, by the $n^{th}$ compensation sub-module, the data voltage from the data line to the second electrode of the $n^{th}$ driving transistor, and enabling the gate electrode of the $n^{th}$ driving transistor to be electrically connected to the first electrode of the $n^{th}$ driving transistor, to charge or discharge the $n^{th}$ charging/discharging sub-module until a potential at the gate electrode of the $n^{th}$ driving transistor is equal to a sum of the data voltage and the threshold voltage of the $n^{th}$ driving transistor; and within an $n^{th}$ light-emission time period of the light-emission stage, enabling, by the $n^{th}$ driving control sub-module, the first electrode of the $n^{th}$ driving transistor to be electrically connected to the high level output end under the control of the driving control signal from the driving control line, and under the control of the M light-emission control signals from the M light-emission control lines, enabling, by the $n^{th}$ light-emission control sub-module, the M light-emitting elements connected to the $n^{th}$ pixel driving control module to emit light simultaneously based on the data voltage, and compensating for the threshold voltage of the $n^{th}$ driving transistor with the gate-to-source voltage of the $n^{th}$ driving transistor, where m is an integer greater than or equal to 1 and smaller than or equal to M.

20. The method according to claim 14, wherein the display control signal generation step further comprises generating, by the driving control unit, the low resolution control signal or the high resolution control signal based on an external distance, and the external distance is a distance between a human eye and a display panel.

* * * * *